US011433281B2

(12) United States Patent
Seluga et al.

(10) Patent No.: US 11,433,281 B2
(45) **Date of Patent: *Sep. 6, 2022**

(54) METHOD OF MANUFACTURING GOLF CLUB HEAD HAVING STRESS-REDUCING FEATURES

(71) Applicant: Callaway Golf Company, Carlsbad, CA (US)

(72) Inventors: James A. Seluga, Carlsbad, CA (US); Matthew Myers, Carlsbad, CA (US); Christopher A. G. Nunez, Escondido, CA (US); Timothy G. Scott, Encinitas, CA (US); Jeremy R. Hanhart, Oceanside, CA (US); Kelsey Bazshushtari, Encinitas, CA (US); Robert S. Gonczi, Oceanside, CA (US); Alex Power, Carlsbad, CA (US); Romulus M. Tomimbang, San Diego, CA (US); Justin Del Rosario, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/375,180

(22) Filed: Jul. 14, 2021

(65) Prior Publication Data

US 2021/0339093 A1 Nov. 4, 2021

Related U.S. Application Data

(60) Continuation-in-part of application No. 16/742,743, filed on Jan. 14, 2020, now Pat. No. 11,083,937,
(Continued)

(51) Int. Cl.
*B22C 7/02* (2006.01)
*B22C 9/04* (2006.01)
(Continued)

(52) U.S. Cl.
CPC ..... *A63B 53/0466* (2013.01); *A63B 60/02* (2015.10); *A63B 60/52* (2015.10);
(Continued)

(58) Field of Classification Search
CPC .. B22C 7/02; B22C 7/023; B22C 9/04; B22C 9/046; B22C 9/24
(Continued)

(56) References Cited

U.S. PATENT DOCUMENTS 11,083,937 B2 * 8/2021 Gibbs et al. ..... B21K 17/00
2021/0370144 A1 * 12/2021 Gibbs et al. ..... A63B 60/02

* cited by examiner

*Primary Examiner* — Kevin P Kerns
(74) *Attorney, Agent, or Firm* — Rebecca Hanovice; Michael Catania; Sonia Lari

(57) ABSTRACT

Methods of manufacturing a golf club head with one or more stiffening members proximate the face, and particularly solid rods or a plate with one or more cutouts, is disclosed herein. One method includes the steps of preparing a wax mold of a golf club head including a plate stiffening member with excess material, casting the golf club head, and machining away the excess material. Another method includes the steps of casting a golf club body, providing a plate stiffening member, providing a face component such as a face cup, tack welding the plate stiffening member and the face component to the golf club body, and welding these parts together.

11 Claims, 18 Drawing Sheets

Related U.S. Application Data which is a continuation-in-part of application No. 16/411,491, filed on May 14, 2019, now Pat. No. 10,532,258, which is a division of application No. 15/912,247, filed on Mar. 5, 2018, now Pat. No. 10,335,647, which is a continuation of application No. 15/808,025, filed on Nov. 9, 2017, now Pat. No. 9,931,550, which is a continuation-in-part of application No. 15/628,514, filed on Jun. 20, 2017, now Pat. No. 9,908,017, which is a continuation of application No. 15/447,638, filed on Mar. 2, 2017, now Pat. No. 9,687,702.

(60) Provisional application No. 63/136,759, filed on Jan. 13, 2021, provisional application No. 62/442,892, filed on Jan. 5, 2017.

(51) Int. Cl.

| | |
|---|---|
| ***B22C 9/24*** | (2006.01) |
| ***A63B 53/04*** | (2015.01) |
| ***A63B 60/52*** | (2015.01) |
| ***A63B 60/02*** | (2015.01) |
| ***B21K 17/00*** | (2006.01) |
| *A63B 60/42* | (2015.01) |

(52) U.S. Cl.

CPC ..... *B21K 17/00* (2013.01); *B22C 7/02* (2013.01); *B22C 9/24* (2013.01); *A63B 53/045* (2020.08); *A63B 53/047* (2013.01); *A63B 53/0408* (2020.08); *A63B 53/0412* (2020.08); *A63B 53/0433* (2020.08); *A63B 53/0437* (2020.08); *A63B 53/0454* (2020.08); *A63B 53/0458* (2020.08); *A63B 60/42* (2015.10); *A63B 2053/0491* (2013.01); *A63B 2209/00* (2013.01)

(58) Field of Classification Search

USPC ..... 164/35, 45, 76.1; 473/346

See application file for complete search history.

METHOD OF MANUFACTURING GOLF CLUB HEAD HAVING STRESS-REDUCING FEATURES

CROSS REFERENCES TO RELATED APPLICATIONS

The present invention claims priority to U.S. Provisional Application No. 63/136,759, filed on Jan. 13, 2021, and is a continuation-in-part of U.S. patent application Ser. No. 16/742,743, filed on Jan. 14, 2020, and issued on Aug. 10, 2021, as U.S. Pat. No. 11,083,937, which is a continuation-in-part of U.S. patent application Ser. No. 16/411,491, filed on May 14, 2019, and issued on Jan. 14, 2020, as U.S. Pat. No. 10,532,258, which is a divisional of U.S. patent application Ser. No. 15/912,247, filed on Mar. 5, 2018, and issued on Jul. 2, 2019, as U.S. Pat. No. 10,335,647, which is a continuation of U.S. patent application Ser. No. 15/808,025, filed on Nov. 9, 2017, and issued on Apr. 3, 2018, as U.S. Pat. No. 9,931,550, which claims priority to U.S. Provisional Patent Application No. 62/442,892, filed on Jan. 5, 2017, and is also a continuation-in-part of U.S. patent application Ser. No. 15/628,514, filed on Jun. 20, 2017, and issued on Mar. 6, 2018, as U.S. Pat. No. 9,908,017, which is a continuation of U.S. patent application Ser. No. 15/447,638, filed on Mar. 2, 2017, and issued on Jun. 27, 2017 as U.S. Pat. No. 9,687,702, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a method of manufacturing a golf club head with stress-reducing stiffening members, the stress-reducing stiffening members connecting a crown portion with a sole portion via a hollow interior and disposed proximate a striking face section.

Description of the Related Art

The prior art discloses various golf club heads having interior structures. For example, Kosmatka, U.S. Pat. No. 6,299,547 for a Golf Club Head With an Internal Striking Plate Brace, discloses a golf club head with a brace to limit the deflection of the striking plate, Yabu, U.S. Pat. No. 6,852,038 for a Golf Club Head And Method of Making The Same, discloses a golf club head with a sound bar, Galloway, U.S. Pat. No. 7,118,493 for a Multiple Material Golf Club Head, discloses a golf club head with a composite aft body having an interior sound component extending upward from a sole section of a metal face component, Seluga et al., U.S. Pat. No. 8,834,294 for a Golf Club Head With Center Of Gravity Adjustability, discloses a golf club head with a tube having a mass for adjusting the CG of a golf club head, and Dawson et al., U.S. Pat. No. 8,900,070 for a Weighted Golf Club Head discloses a golf club head with an interior weight lip extending from the sole towards the face. However, the prior art fails to disclose an interior structure that increases ball speed through reducing stress in the striking face section at impact, with a minimal increase in mass to the golf club head.

BRIEF SUMMARY OF THE INVENTION

The present invention is directed to a method of manufacturing a golf club head comprising interior structures connecting a return section to a sole section to reduce the stress in a striking face section during impact with a golf ball. The interior structures are a plate or one or more solid rods that are co-cast with a body portion of the golf club head via standard casting and/or wax-welding processes.

One aspect of the present invention is a method comprising the steps of preparing a wax of a golf club head body, the wax of the golf club head body comprising a striking face section, a sole section extending from a lower edge of the striking face section, and a return section extending from an upper edge of the striking face section, the striking face section, sole section, and return section defining a hollow body interior, the return section comprising an elongated through-hole, and the sole section comprising an elongated receiving pocket, preparing a wax of a plate comprising an upper end and a lower end, inserting the plate into the elongated through-hole and seating the lower end in the elongated receiving pocket, bonding the plate to the body with an adhesive material to form a combined wax mold, and casting a golf club head from the combined wax mold, wherein the through-hole is aligned with the receiving pocket, wherein the plate is has a variable thickness ranging from 0.020 inch to 0.160 inch, wherein the plate is located within 1 inch of a rear surface of the striking face section measured along a vertical plane extending through a face center perpendicular to the striking face section, and wherein no portion of the plate makes contact with the striking face section.

In some embodiments, the plate may be spaced a distance of no more than 0.210 inch from the rear surface. In other embodiments, the step of bonding the plate to the body may comprise applying glue around an entire circumference of each of the upper and lower ends of the plate. In still other embodiments, the method may further comprise the step of applying hot wax to the upper end of the plate to seal it to the return section after the step of bonding the plate to the body. In yet another embodiment, the step of casting a golf club head from the combined wax mold may comprise casting the golf club head from a titanium alloy. In any of these embodiments, the plate may comprise at least one cutout. In another embodiment, the plate may have a length of 1 inch to 2.5 inches. In some embodiments, the upper end may be spaced a first distance from the rear surface, the lower end may be spaced a second distance from the rear surface, and the second distance may be greater than the first distance. In a further embodiment, the first distance may be 0.120 inch to 0.150 inch, and the second distance may be 0.180 inch to 0.210 inch. In any of the embodiments, the plate may extend through the hollow body interior approximately parallel with the rear surface.

Another aspect of the present invention is a method comprising the steps of: preparing a wax of a golf club head body, the wax of the golf club head body comprising a striking face section, a sole section extending from a lower edge of the striking face section, and a return section extending from an upper edge of the striking face section, the striking face section, sole section, and return section defining a hollow body interior, the return section comprising an elongated receiving pocket, and the sole section comprising an elongated through-hole, preparing a wax of a plate comprising an upper end, a lower end, and at least one cutout, inserting the plate into the elongated through-hole and seating the upper end in the elongated receiving pocket so that the plate is located within 1 inch of a rear surface of the striking face section measured along a vertical plane extending through a face center perpendicular to the striking face section, bonding the plate to the body with an adhesive material to form a combined wax mold, and casting a golf club head from the combined wax mold, wherein the through-bore is aligned with the receiving pocket, wherein the plate is has a variable thickness ranging from 0.020 inch to 0.160 inch, and wherein no portion of the plate makes contact with the striking face section.

In some embodiments, the step of bonding the plate to the body may comprise applying glue around an entire circumference of each of the upper and lower ends of the plate. In another embodiment, the method may further comprise the step of applying hot wax to the lower end of the plate to seal it to the sole section after the step of bonding the plate to the body. In any of the embodiments, the step of casting a golf club head from the combined wax mold may comprise casting the golf club head from a titanium alloy. In still other embodiments, the plate may have a length of 1 inch to 2.5 inches, and the plate may extend through the hollow body interior approximately parallel with the rear surface.

Yet another aspect of the present invention is a method comprising the steps of preparing a wax of a golf club head body, the wax of the golf club head body comprising a striking face section, a sole section extending from a lower edge of the striking face section, and a return section extending from an upper edge of the striking face section, the striking face section, sole section, and return section defining a hollow body interior, the return section comprising an elongated receiving pocket, and the sole section comprising an elongated through-hole, preparing a wax of a plate comprising at least one cutout, an upper end, and a lower end, inserting the plate into the elongated through-hole and seating the upper end in the elongated receiving pocket so that the plate is located within 1 inch of a rear surface of the striking face section measured along a vertical plane extending through a face center perpendicular to the striking face section, bonding the plate to the body with an adhesive material to form a combined wax mold, applying hot wax to the lower end of the plate to seal the lower end of the plate to the sole section and casting a golf club head from the combined wax mold, wherein the through-bore is aligned with the receiving pocket, wherein the plate has a variable thickness ranging from 0.020 inch to 0.160 inch and a length of 1 inch to 2.5 inches, wherein the plate extends through the hollow body interior approximately parallel with the rear surface, and wherein no portion of the plate makes contact with the striking face section.

In some embodiments, the plate may comprise a flared region at the lower end sized to fill the elongated through-hole. In still another embodiment, the plate may comprise a plurality of cutouts. In yet another embodiment, the step of bonding the plate to the body may comprise applying glue around an entire circumference of each of the upper and lower ends of the plate.

Yet another aspect of the present invention is a method comprising the steps of preparing a wax mold of a golf club head body, the wax mold comprising a striking face section, a front opening, a sole section extending from a lower edge of the striking face section, a return section extending from an upper edge of the striking face section, and a plate stiffening member extending from the return section to the sole section, the striking face section, sole section, and return section defining a hollow body interior, casting from the wax mold a preliminary golf club head comprising a plate stiffening member with excess material, and machining the excess material away from the plate, wherein the plate is has a thickness ranging from 0.020 inch to 0.160 inch, wherein the plate is located within 1 inch of a rear surface of the striking face section measured along a vertical plane extending through a face center perpendicular to the striking face section, and wherein no portion of the plate makes contact with the striking face section.

In some embodiments, the plate may be spaced a distance of no more than 0.210 inch from the rear surface, and the step of casting a golf club head from the wax mold may comprise casting the golf club head from a titanium alloy. In some embodiments, the plate may comprise at least one cutout, which may align with the face center along the vertical plane. In any of the embodiments, the plate may have a length of 1 inch to 2.5 inches. In other embodiments, the plate may extend through the hollow body interior approximately parallel with the rear surface. In some embodiments, the excess material may follow an s-curve shape. In still other embodiments, the sole section may comprise an interior weight, and the plate may extend from the interior weight to the return section. In any of the embodiments, the excess material may comprise a heel side wall extending in a front-rear direction from a heel-side portion of the striking face section and a toe side wall extending in a front-rear direction from a toe-side portion of the striking face section. In any of the embodiments, the method may further include the step of affixing a face component to the preliminary golf club head to enclose the hollow body interior.

Another aspect of the present invention is a method comprising the steps of casting a golf club body comprising a face section with a face opening, a sole section extending from a lower edge of the face section and comprising a sole cutout, a return section extending from an upper edge of the face section and comprising a return section cutout, the face section, sole section, and return section defining a hollow body interior, providing a plate stiffening member comprising an upper end, a lower end, and at least one plate cutout, providing a face component comprising a striking plate, an upper extension, and a lower extension, tack welding the plate stiffening member to the golf club body so that the upper end fits within the return section cutout and the lower end fits within the sole section cutout, tack welding the upper extension of the face component and the lower extension of the face component to at least a portion of the plate stiffening member or the golf club body so that the upper and lower ends of the plate stiffening member are sandwiched between the body and the face component, and welding the plate stiffening member and the face component to the golf club body.

In some embodiments, the step of welding the plate stiffening member and the face component to the golf club body may be selected from the steps of laser welding and wire-feed welding. In a further embodiment, the step of welding the plate stiffening member and the face component to the golf club body may comprise one-pass wire-feed welding the upper extension to the upper end and the lower extension to the lower end. In another embodiment, the step of welding the plate stiffening member and the face component to the golf club body may comprise laser welding, the plate stiffening member may comprise excess material extending from at least one of the upper end and the lower end, and the laser welding step may use the excess material as centered weld stock.

In any of the embodiments, a portion of the at least one plate cutout may be aligned with a geometric center of the striking plate along a front to rear x-axis. In other embodiments, the step of casting a golf club body may comprise casting the golf club body from a titanium alloy. In some embodiments, the plate stiffening member may have a length of 1 inch to 2.5 inches. In another embodiment, at least a portion of the plate stiffening member may extend through the hollow body interior approximately parallel with a rear surface of the striking face. In any of the embodiments, the plate stiffening member may have a thickness of 0.030 inch to 0.050 inch.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

The present invention is directed to a method of manufacturing a body for a golf club head that includes structural members, also referred to as stiffening members, and particularly a pair of solid rods or a variable thickness plate with or without cutout portions, that extend between a return section and a sole section approximately parallel with a rear surface of a striking face section (and, in the case of multiple stiffening members, with each other) without touching the rear surface (or one another), even during impact with a golf ball. In particular, the present invention is a method of co-casting the stiffening member(s) with the body.

Figure 1:
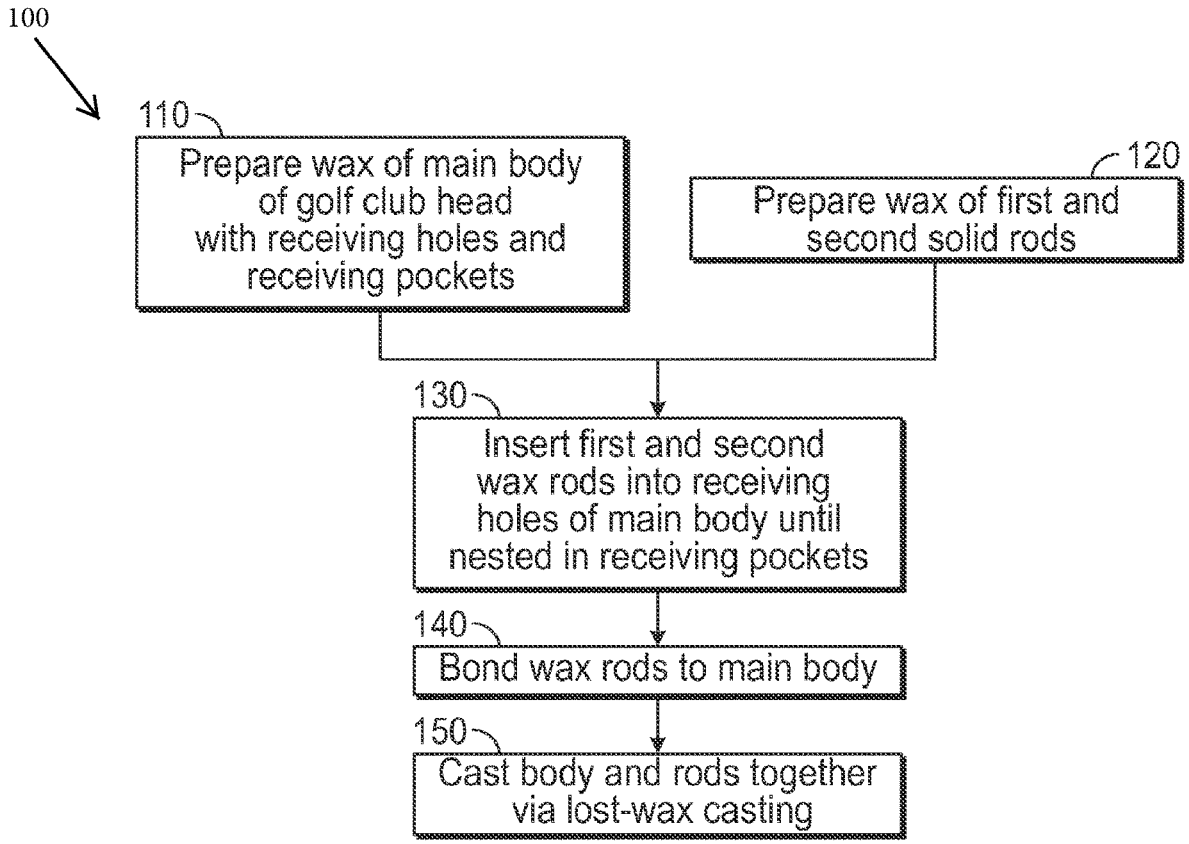
FIG. 1 is a flow chart describing the process of co-casting stiffening members such as one or more rods or a plate with a golf club head body of the present invention.
Figure 2:
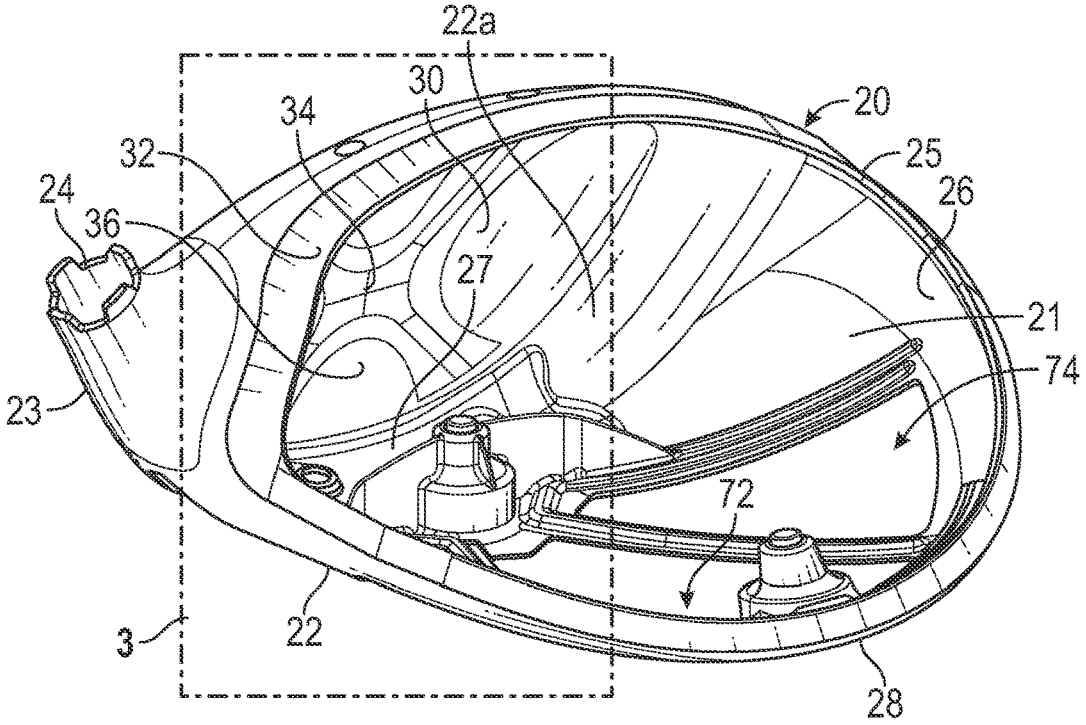
FIG. 2 is a top perspective view of a wax mold of a first embodiment of the golf club head body of the present invention.
Figure 3:
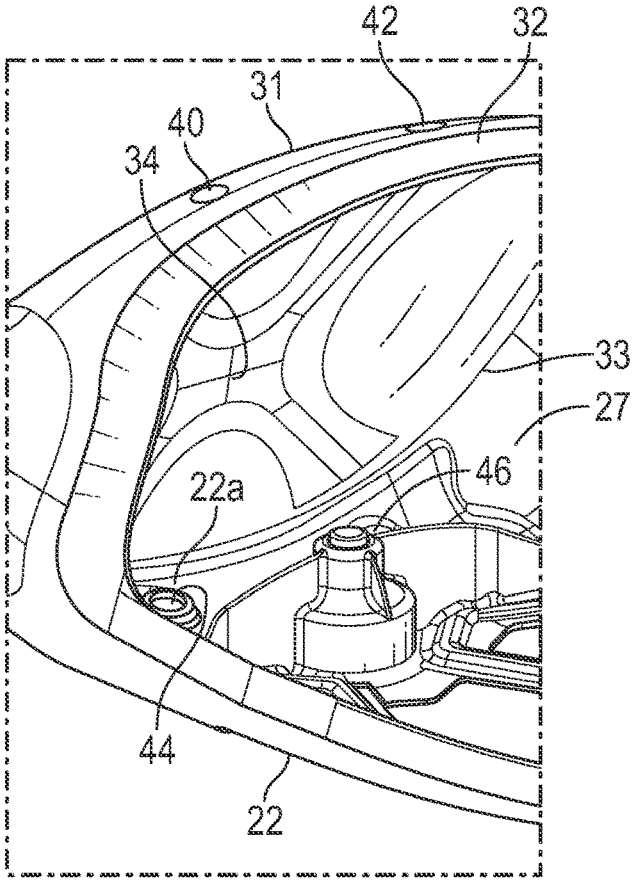
FIG. 3 is an enlarged view of the circled portion of the wax mold shown in FIG. 2.
Figure 4:
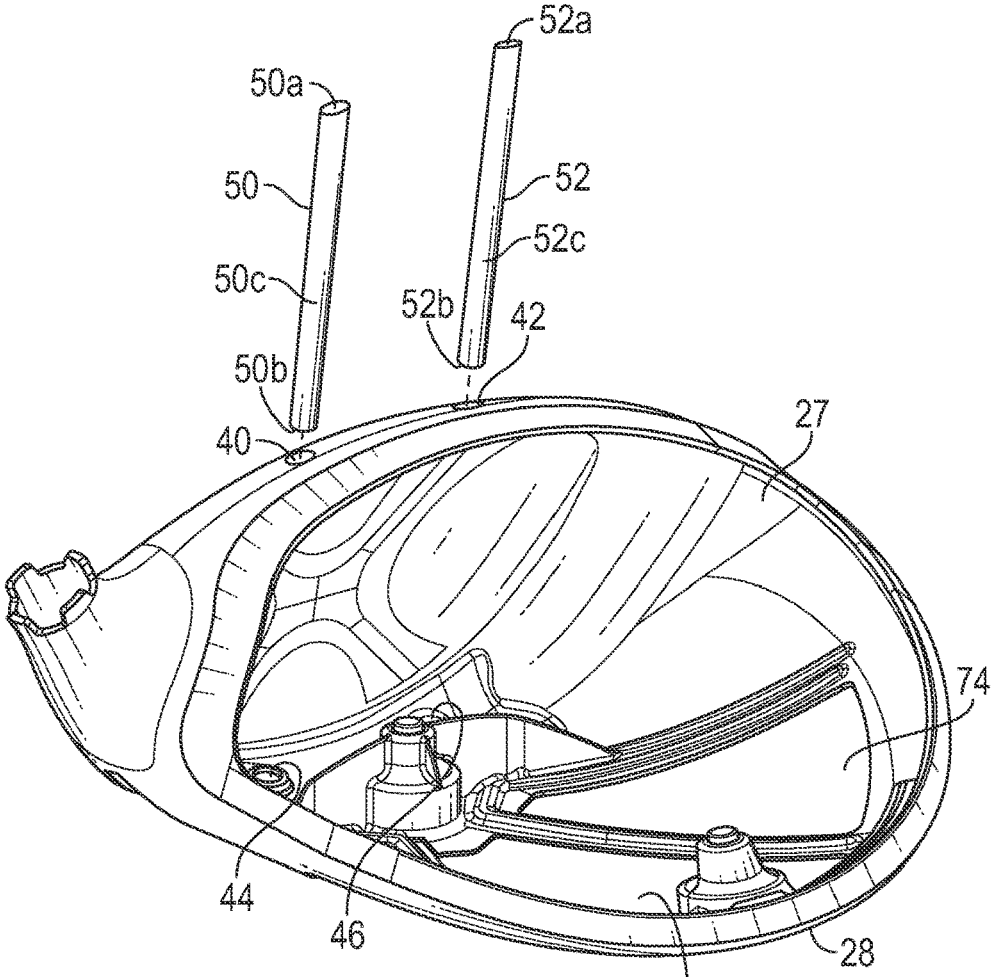
FIG. 4 is an exploded view of the wax mold shown in FIG. 2 with two wax rods.
Figure 5:
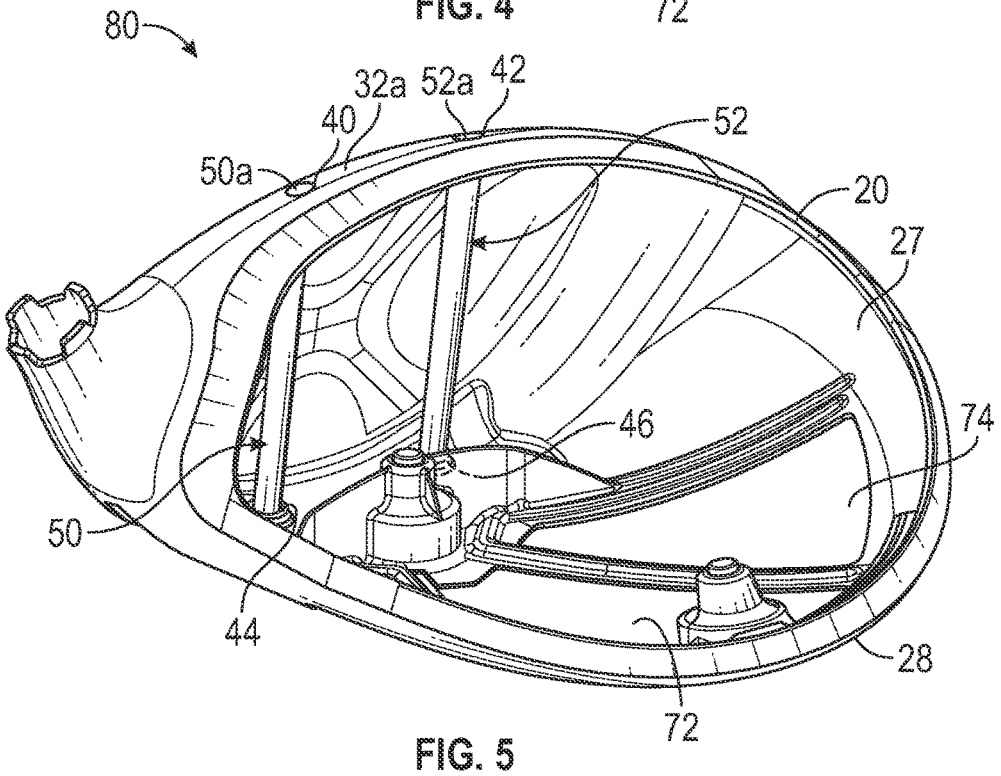
FIG. 5 is a top perspective, assembled view of the wax mold shown in FIG. 4.
Figure 6:
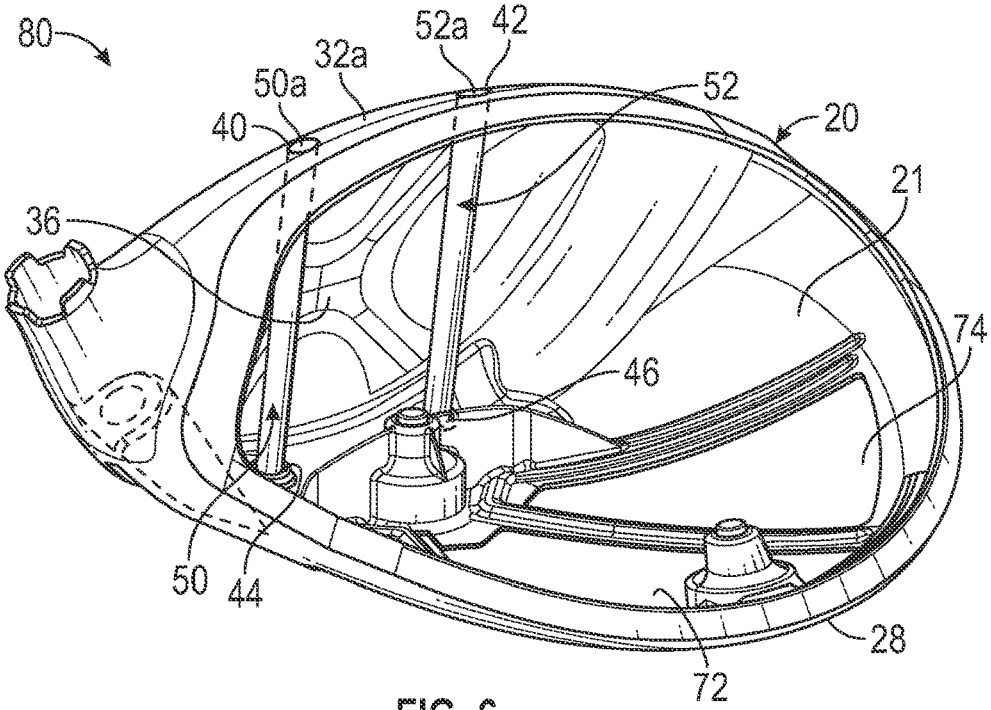
FIG. 6 is a partially transparent view of the wax mold shown in FIG. 5.
Figure 7:
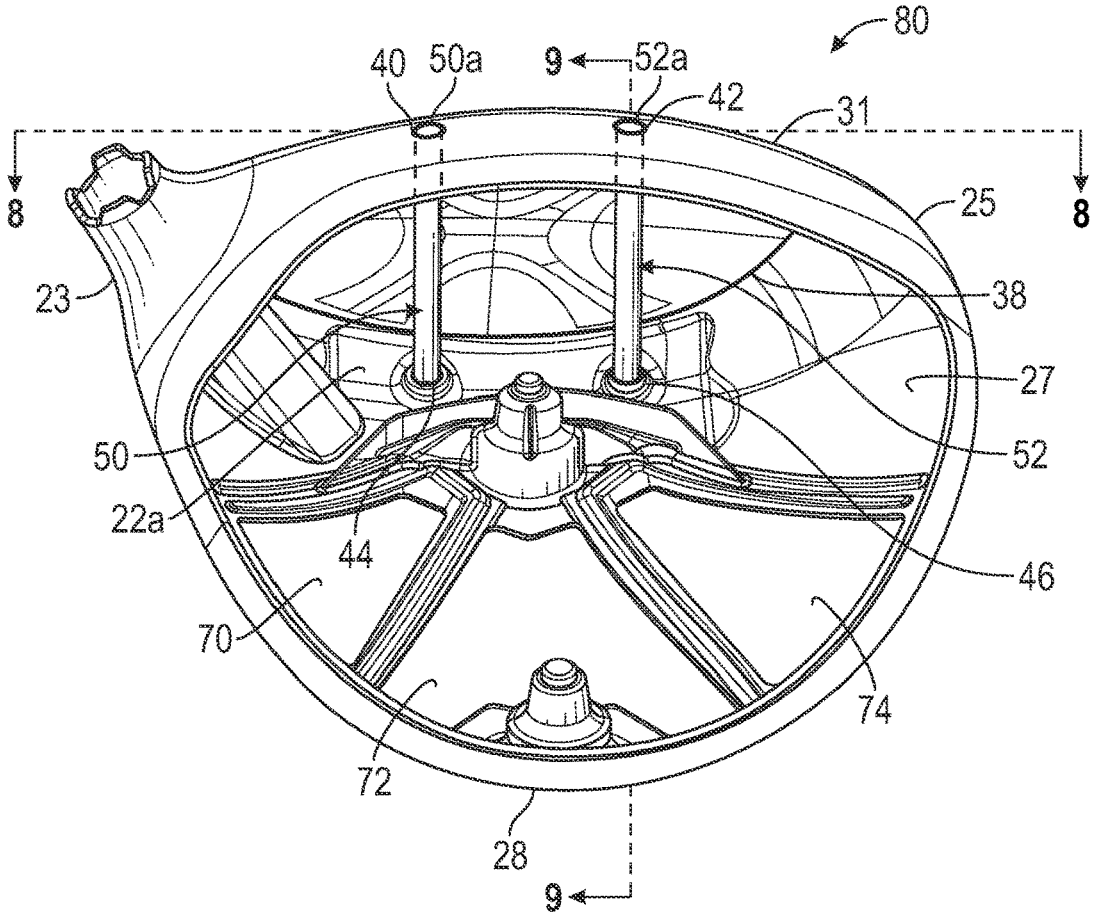
FIG. 7 is a top perspective, partially transparent view of the wax mold shown in FIG. 6.
Figure 8:
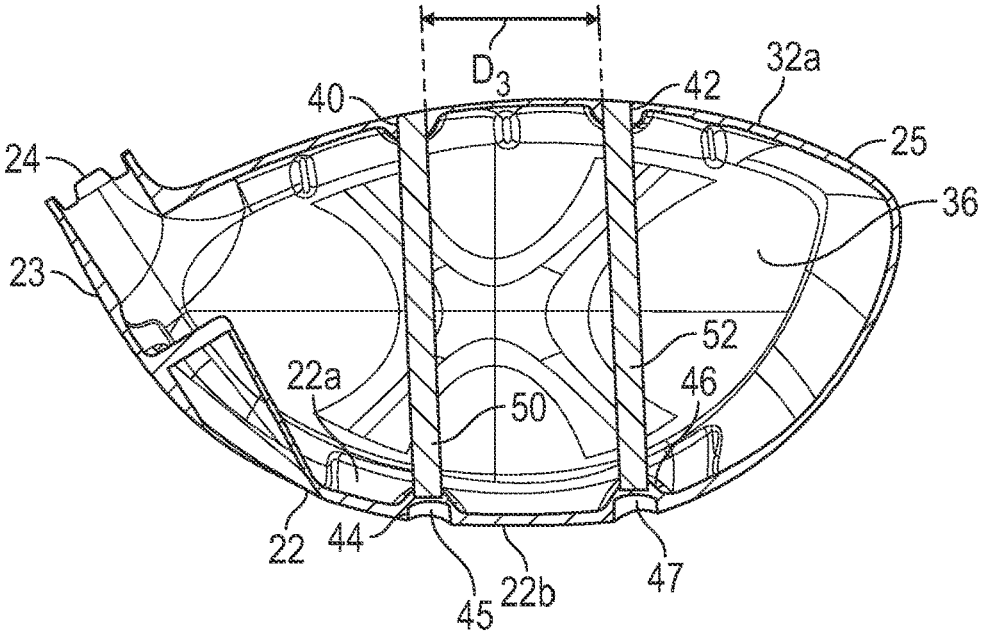
FIG. 8 is a cross-sectional view of the wax mold shown in FIG. 7 along lines 8-8.
Figure 9:
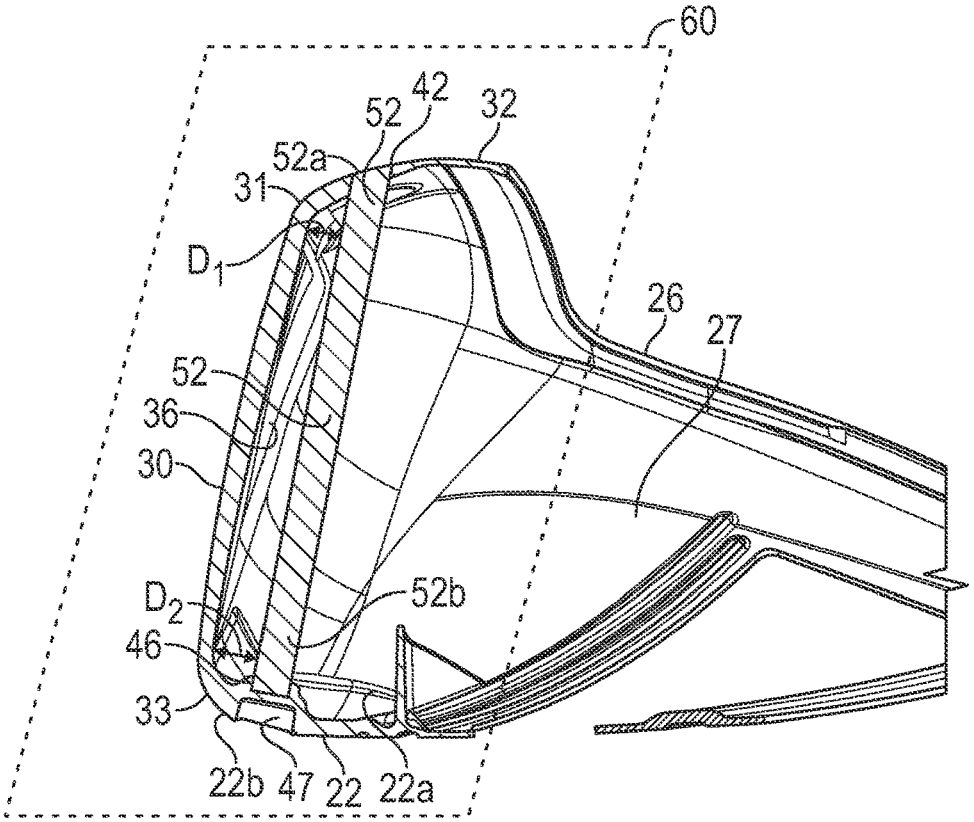
FIG. 9 is a cross-sectional view of the wax mold shown in FIG. 7 along lines 9-9.
Figure 10:
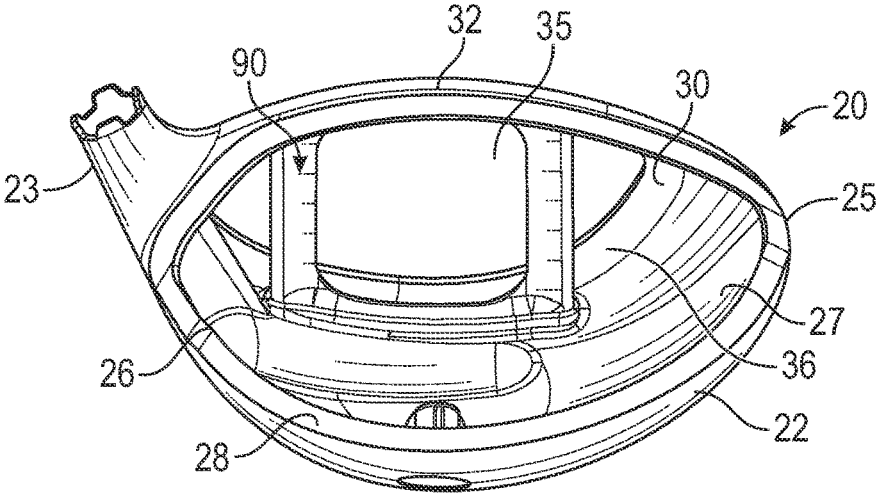
FIG. 10 is a rear elevational view of a wax mold of a second embodiment of the golf club head body of the present invention.
Figure 11:
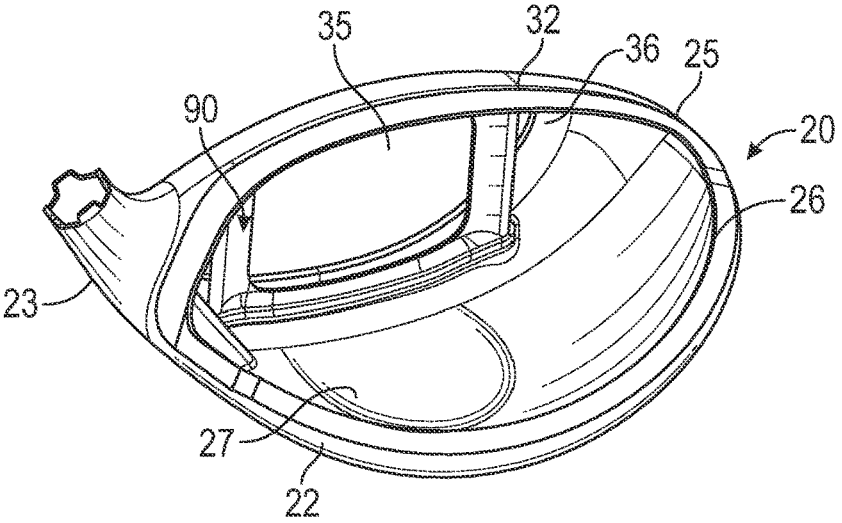
FIG. 11 is a rear perspective view of the wax mold shown in FIG. 10.
Figure 12:
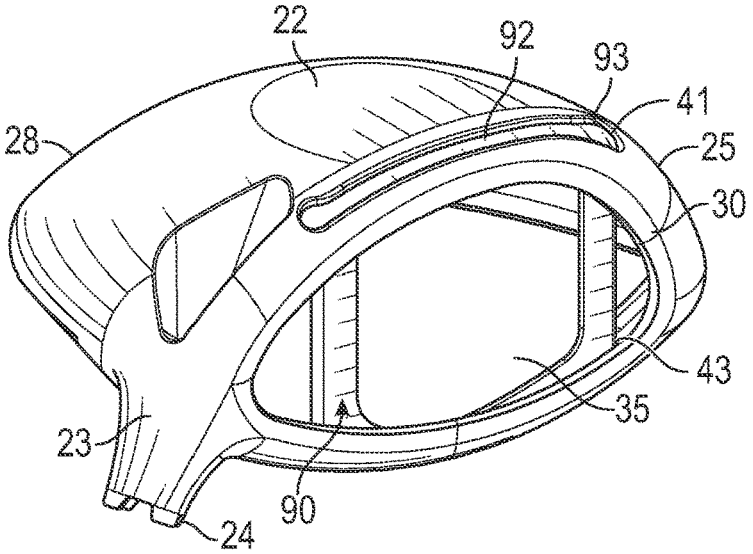
FIG. 12 is a sole perspective view of the wax mold shown in FIG. 10.
Figure 13:
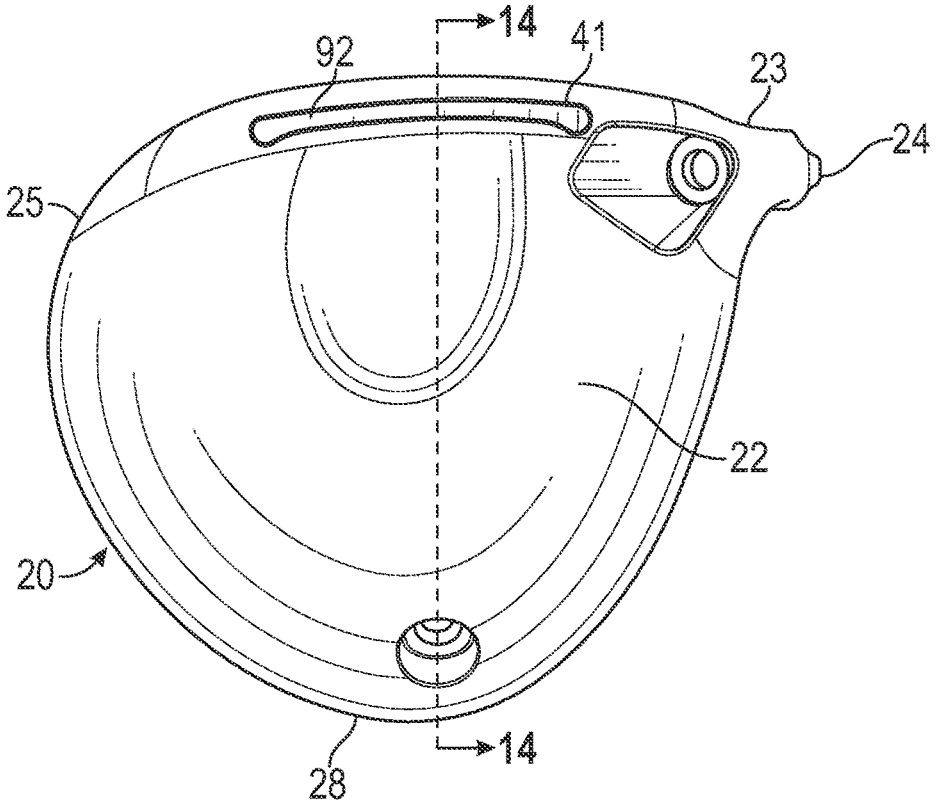
FIG. 13 is a sole plan view of the wax mold shown in FIG. 10.
Figure 14:
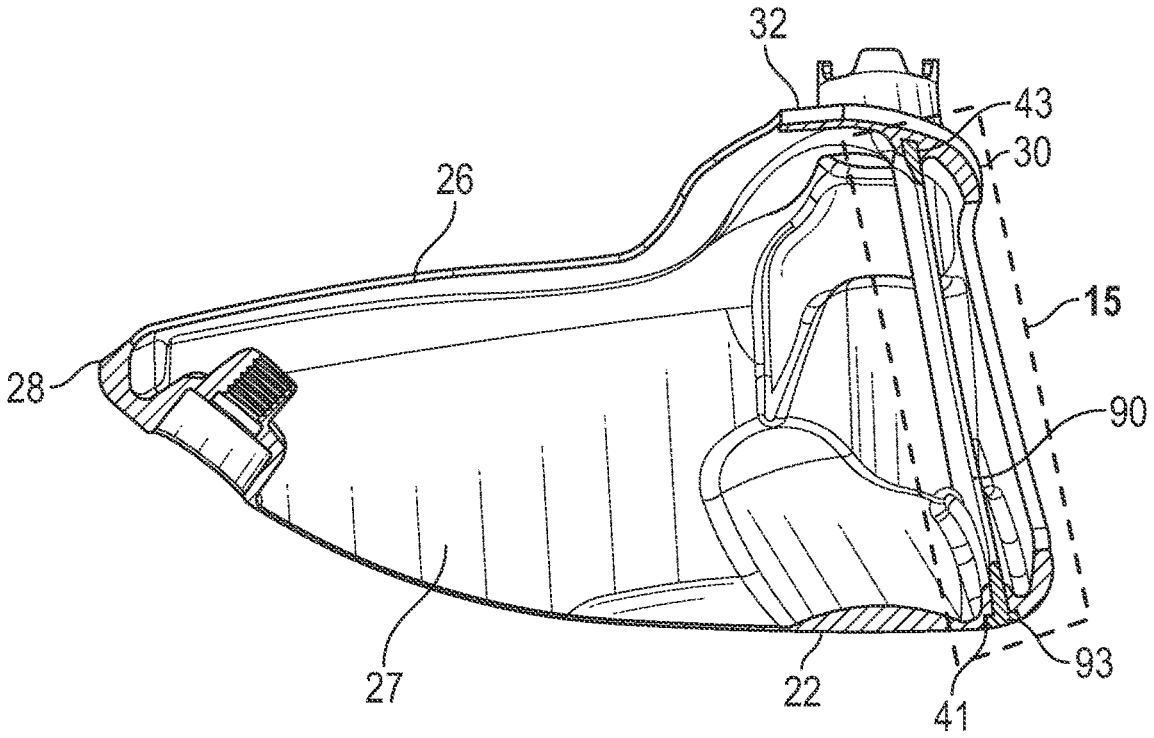
FIG. 14 is a cross-sectional view of the wax mold shown in FIG. 13 along lines 14-14.
Figure 15:
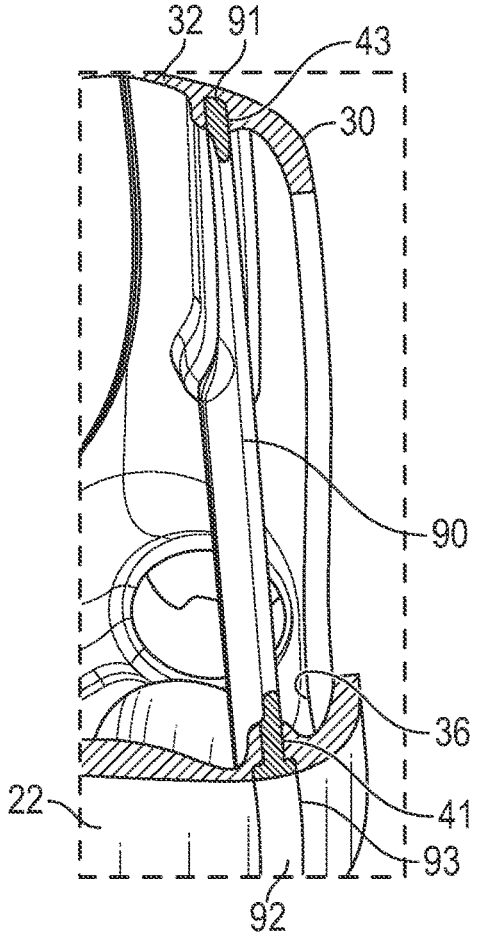
FIG. 15 is an enlarged, angled view of the circled portion of the embodiment shown in FIG. 14.
Figure 16:
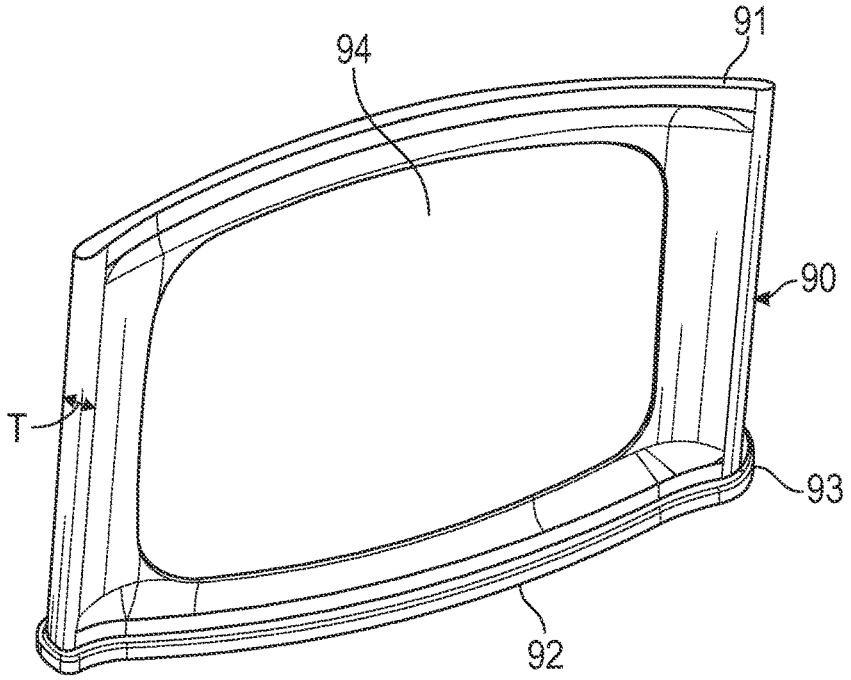
FIG. 16 is a rear elevational view of the wax plate portion of the wax mold shown in FIG. 10.
Figure 17:
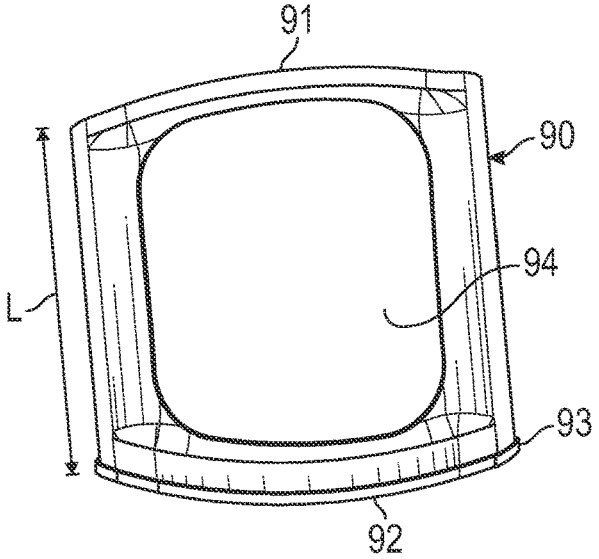
FIG. 17 is a rear plan view of the wax plate shown in FIG. 16.

As illustrated in FIG. 1, a first method 100 includes a first step 110 of preparing a wax of the main body 20. As shown in FIGS. 2-9, the wax of the main body 20 in a first embodiment has a striking face section 30 with a face center 34 and a rear surface 36, a return section 32 extending rearwards away from an upper edge 31 of the striking face section 30, a sole section 22 extending rearwards away from a lower edge 33 of the striking face section 30, a hosel 24 for engaging a shaft, a heel end 23, a toe end 25, an upper opening 26, a hollow interior 27, and an aft end 28. A pair of holes 40, 42 extends through the return section 32 and communicates with the hollow interior 27; each hole 40, 42 is aligned with one of a pair of receiving pockets or bosses 44, 46 extending from an interior surface 22*a* of the sole section 22 into the hollow interior 27. As shown in FIGS. 8 and 9, shallow depressions 45, 47 extend into an outer surface 22*b* of the sole section 22 and are aligned with the receiving pockets 44, 46 to indicate their locations within the hollow interior 27. This configuration can be reversed in an alternative embodiment, such that the holes 40, 42 extend through the sole section 22 and the receiving pockets or bosses 44, 46 extend from the return section 32 into the hollow interior 27. The body 20 also includes three cutouts 70, 72, 74 in a center area 21 of the sole section 22.

The wax of the main body 20 in other embodiments, such as the second and third (preferred) embodiments shown in FIGS. 10-15 and 18, has many of the same features as that of the first embodiment, except that it includes a cutout portion 35 in the striking face section 30 sized to receive a face insert (not shown), a single, elongated hole 41 extending into the sole section 22, and a single, elongated receiving pocket 43 extending from the return section 32 into the hollow interior 27. Both the elongated hole 41 and the elongated receiving pocket 43 extend in a heel 23 to toe 25 direction approximately parallel with the striking face section 30. The configuration of the elongated hole 41 and the elongated receiving pocket 43 may be reversed in alternative embodiments, such that the elongated hole 41 extends through the return section 32 and the receiving pocket 43 may extend from the sole section 22 into the hollow interior 27. Either way, the elongated hole 41 aligns with the elongated receiving pocket 43.

The body 20 in any and all embodiments disclosed herein preferably has a volume from 200 cubic centimeters to 600 cubic centimeters, more preferably from 300 cubic centimeters to 500 cubic centimeters, and most preferably from 420 cubic centimeters to 470 cubic centimeters, with a most preferred volume of 450 to 460 cubic centimeters. The striking face section 30 or face insert (not shown) preferably has a varying thickness such as that described in U.S. Pat. No. 7,448,960, for a Golf Club Head With Variable Face Thickness, which is hereby incorporated by reference. Other alternative embodiments of the thickness of the striking face section 30 or face insert (not shown) are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which are hereby incorporated by reference. Alternatively, the striking face section 30 or face insert (not shown) may have a uniform thickness.

The second step 120, preparing a wax of one or more stiffening members, can be performed at the same time as the first step 110. As shown in the first embodiment, the stiffening members are solid rods 50, 52, each of which is cylindrical, has a diameter of 0.050 inch to 0.200 inch, and has a length of 1 to 2.5 inches. Each of the rods 50, 52 also has an upper end 50*a*, 52*a* and a lower end 50*b*, 52*b*. The solid rods 50, 52 have a variable diameter to reduce their overall mass, such that the upper ends 50*a*, 52*a* and lower ends 50*b*, 52*b* have diameters that are larger than, and taper towards, a midpoint 50*c*, 52*c* of the solid rods 50, 52, so that the solid rods 50, 52 each has an approximate hourglass shape. In the first embodiment, the upper ends 50*a*, 52*a* and lower ends 50*b*, 52*b* have a diameter of 0.140 to 0.170 inch, while the midpoints 50*c*, 52*c* have a diameter of 0.100 to 0.125 inch.

Figure 18:
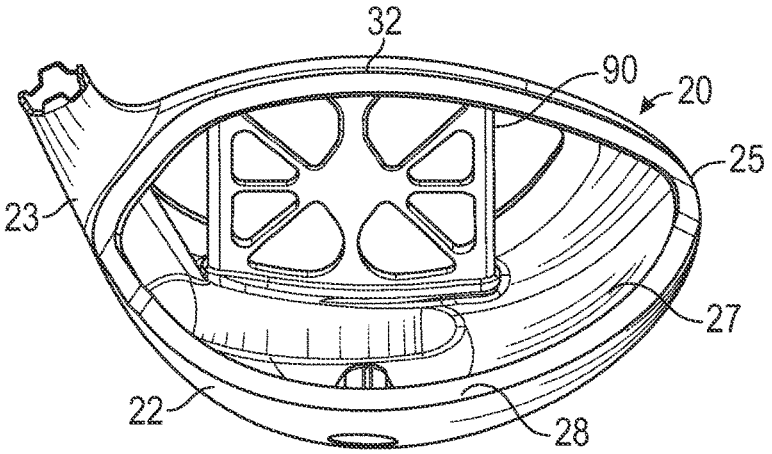
FIG. 18 is a rear elevational view of a wax mold of a third embodiment of the golf club head body of the present invention.
Figure 19:
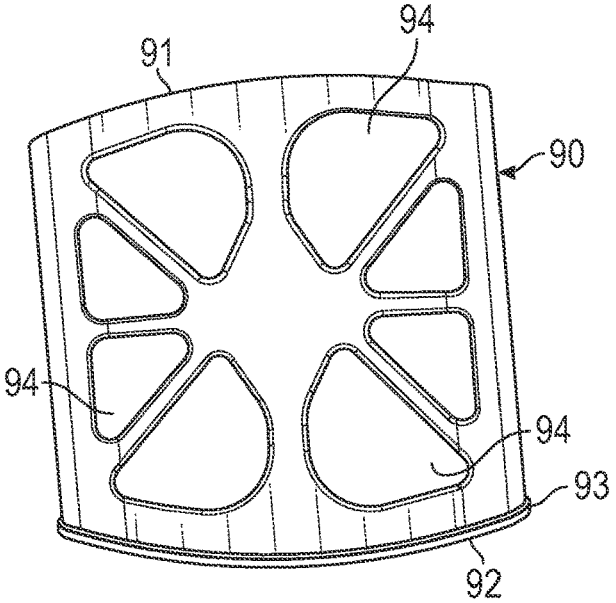
FIG. 19 is a rear plan view of the wax plate portion of the wax mold shown in FIG. 18.
Figure 20:
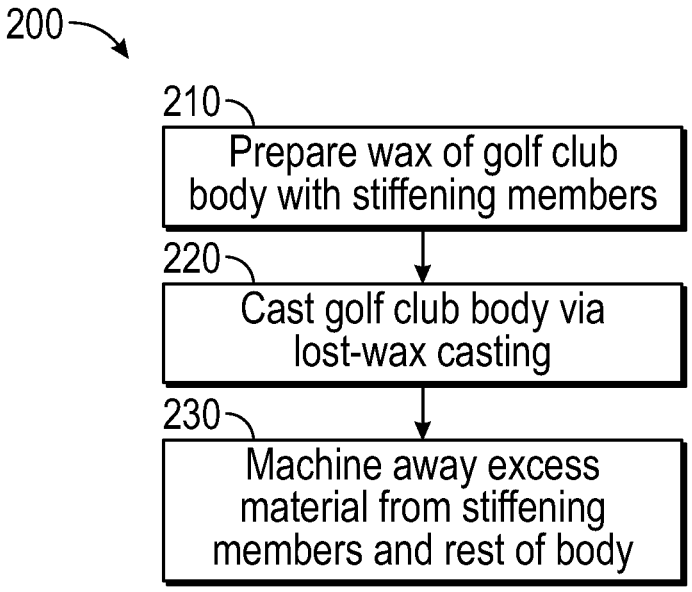
FIG. 20 is a flow chart describing another process of creating a golf club head with internal stiffening members.

In the first embodiment (and any of the other embodiments disclosed herein), the stiffening member is a plate 90 with a variable thickness pattern. The variable thickness pattern may be designed using artificial intelligence or machine learning techniques. The plate has an upper end 91, a lower end 92 with a flared region 93, a vertical length L of 1 inch to 2.5 inches, and a front to back thickness T ranging from 0.020 inch to 0.160 inch. The plate 90 preferably has at least one cutout section 94 as shown in FIGS. 10-17, and more preferably a plurality of cutout sections 94 as shown in FIGS. 18-19 to minimize the overall weight of the plate 90 and to maximize performance benefits of the resulting cast golf club head.

Once the waxes of the main body 20 and the stiffening members (solid rods 50, 52 or plate 90) have been prepared, the third step 130 of the method is performed: with respect to the first embodiment, the first solid rod wax 50 is inserted through the first hole 40 until the lower end 50*b* seats in the first receiving pocket or boss 44, and the second solid rod wax 52 is inserted through the second hole 42 until the lower end 52*b* seats in the second receiving pocket or boss 46. With respect to the second and third embodiments, the wax plate 90 is inserted through the elongated hole 41 until the upper end 91 seats in the elongated receiving pocket 43. The holes 40, 41, 42 and receiving pockets 43, 44, 46 preferably are oriented such that, when engaged with the body 20, each stiffening member 50, 52, 90 is closer to the striking face section 30 than to an aft end 28 of the body 20.

In all of the embodiments disclosed herein, the stiffening members 50, 52, 90 most preferably are both located within 1 inch of the rear surface 36 of the striking face section 30 measured along a vertical plane 60 extending through the face center 34 perpendicular to the striking face section 30. No portion of any stiffening member 50, 52, 90 should be located outside of this 1-inch range; in fact, it is more preferable for each stiffening member 50, 52, 90 to be located even closer to the rear surface 36 of the striking face section 30, e.g., 0.136 inch to 0.210 inch from the rear surface 36, with the upper end 50*a*, 52*a*, 91 of each stiffening member 50, 52, 90 spaced a distance $D_1$ that is slightly closer to the rear surface 36 than the spacing $D_2$ of the lower end 50*b*, 52*b*, 92 as shown in FIG. 9. In the preferred embodiment, $D_1$ ranges from 0.120 inch to 0.150 inch, while $D_2$ ranges from 0.180 inch to 0.210 inch. As shown in FIG. 8, if rods 50, 52 are the stiffening members employed, the rods 50, 52 are also spaced from one another by a distance $D_3$ of 0.500 to 2.00 inch, more preferably approximately 0.75 to 1.50 inch, and most preferably approximately 1.00 inch.

In the fourth step 140, the wax stiffening members 50, 52, 90 are bonded to the wax of the main body 20, preferably using a glue and hot wax. With respect to the first embodiment, the upper ends 50*a*, 52*a* of the solid rods 50, 52 should be flush with an upper surface 32*a* of the return section 32 as shown in FIG. 8, and with respect to the second and third embodiments, lower end 92 of the plate 90 should be flush with the outer surface 22*b* of the sole section 22. The flared region 93 of the lower end 92 of the plate 90 serves to fill in any excess space in the elongated hole 41. In each embodiment, glue is applied around the entire circumference of each stiffening member 50, 52, 90 so that it has a 360° bond to the body 20 at each connection point between the stiffening member 50, 52, 90 and the wax body 20, i.e., at the holes 40, 41, 42 and the receiving pockets 43, 44, 46. Hot wax is then used to melt the upper ends 50*a*, 52*a* of the rods 50, 52 and seal them to the return section 32 for the first embodiment, and to melt the lower end 92 of the plate 90 and seal them to the sole section 22 for the second and third embodiments.

The resulting combined wax mold 80 is then used to cast the body via lost-wax casting 150. In any of the embodiments disclosed herein that require casting steps, the metal used preferably is titanium or a titanium alloy such as 6-4 titanium alloy, alpha-beta titanium alloy or beta titanium alloy for forging, and 6-4 titanium for casting. Alternatively, the body 20 may be composed of 17-4 steel alloy.

Figure 21:
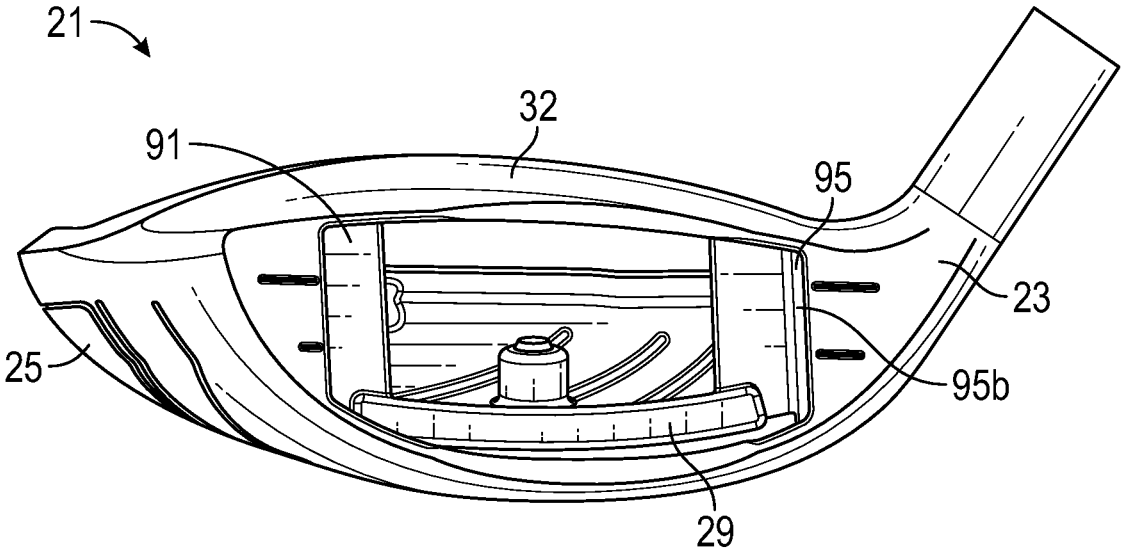
FIG. 21 is a front perspective view of a golf club head created by steps one and two of the process shown in FIG. 20.
Figure 22:
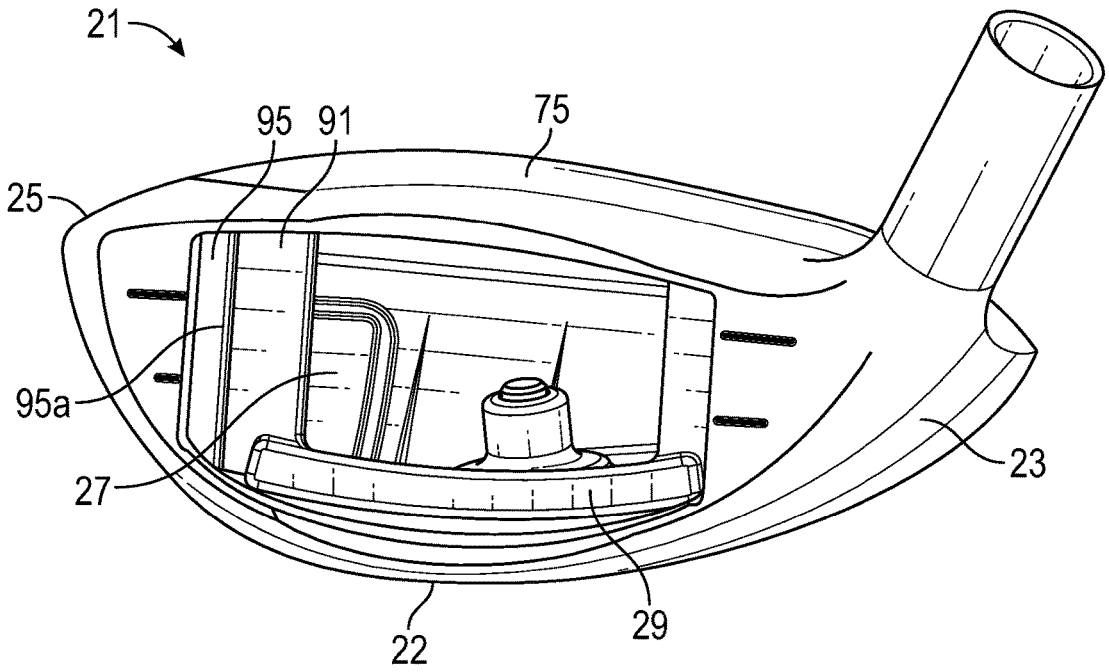
FIG. 22 is a side perspective view of the embodiment shown in FIG. 21.
Figure 23:
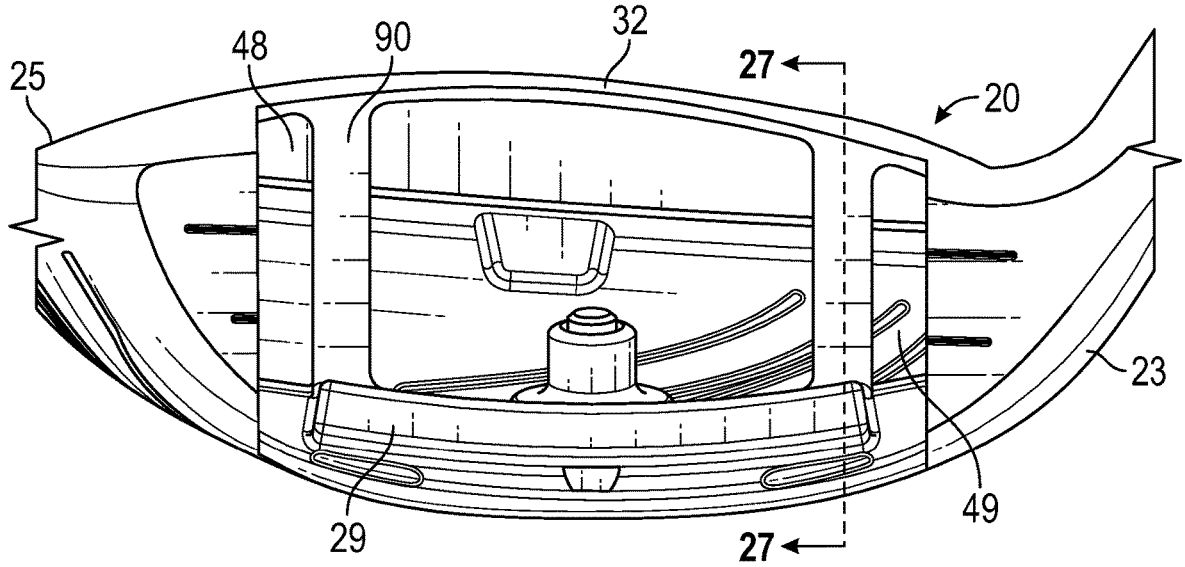
FIG. 23 is a front perspective view of a golf club head created by the entire process shown in FIG. 21.
Figure 24:
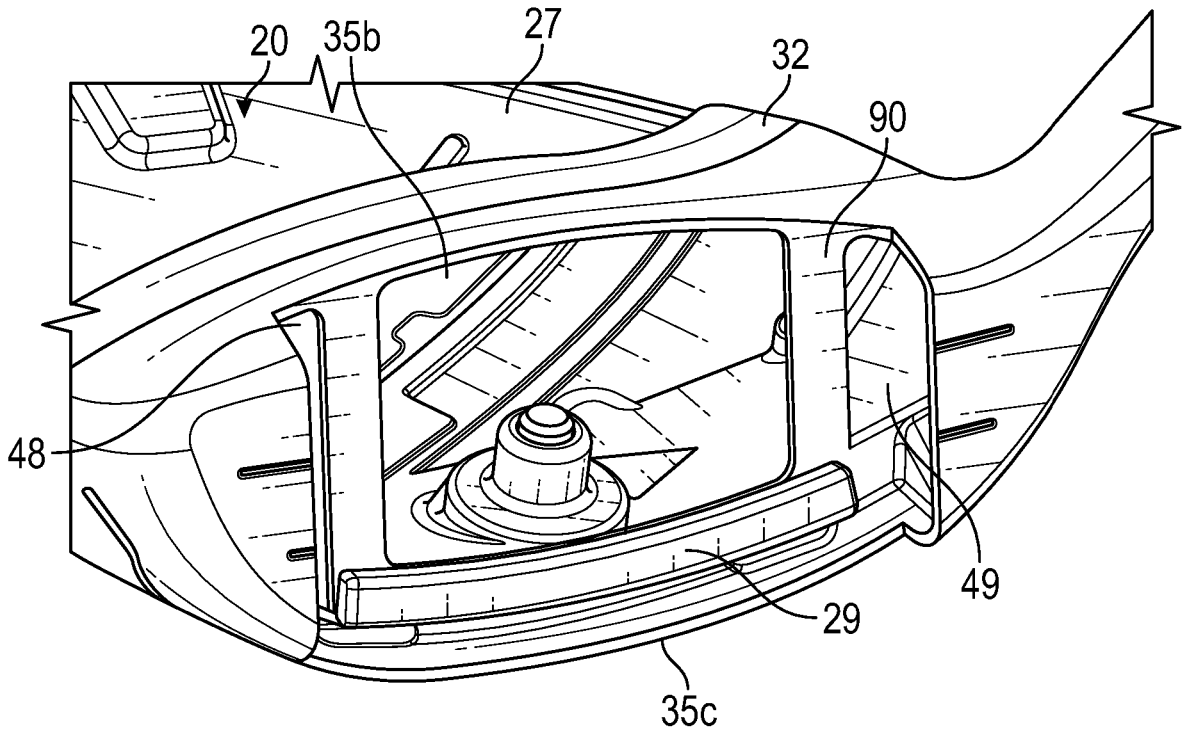
FIG. 24 is a side perspective view of the embodiment shown in FIG. 23.
Figure 25:
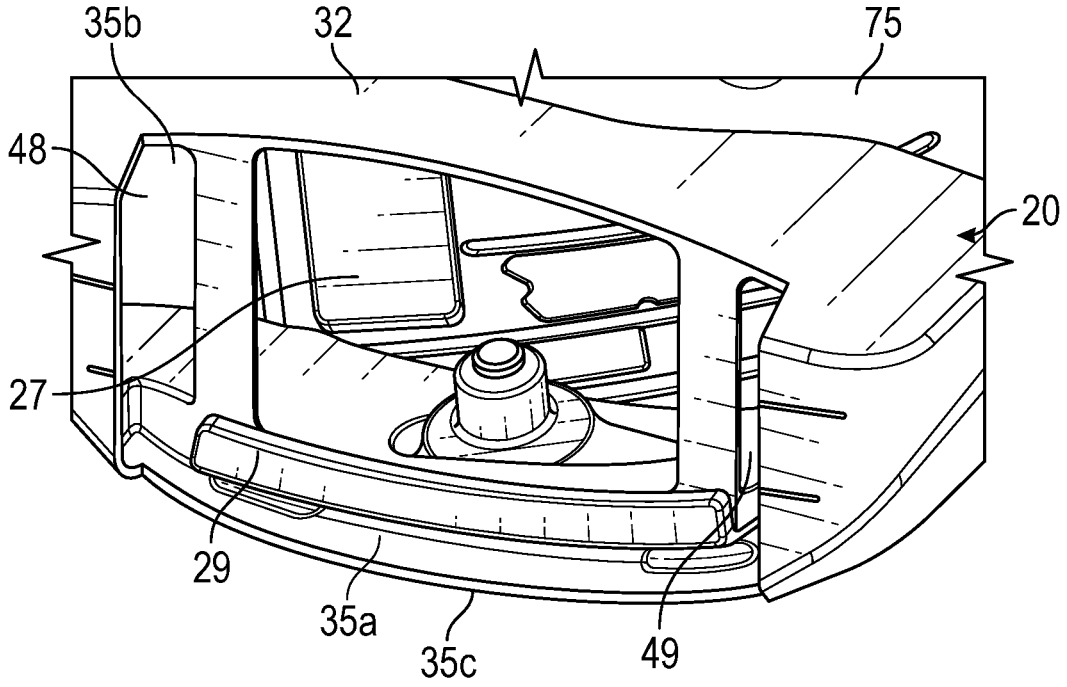
FIG. 25 is another side perspective view of the embodiment shown in FIG. 23.
Figure 26:
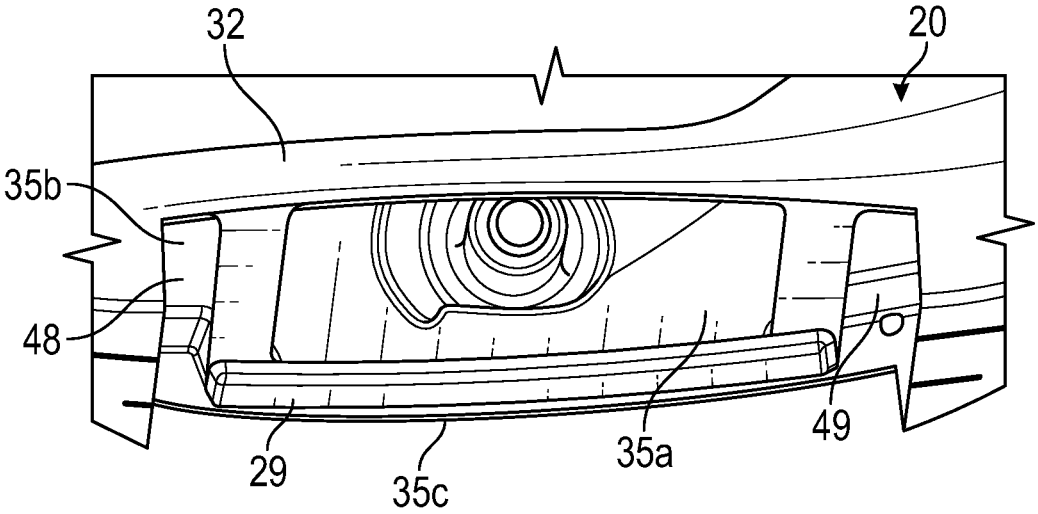
FIG. 26 is a top perspective view of the embodiment shown in FIG. 23.
Figure 27:
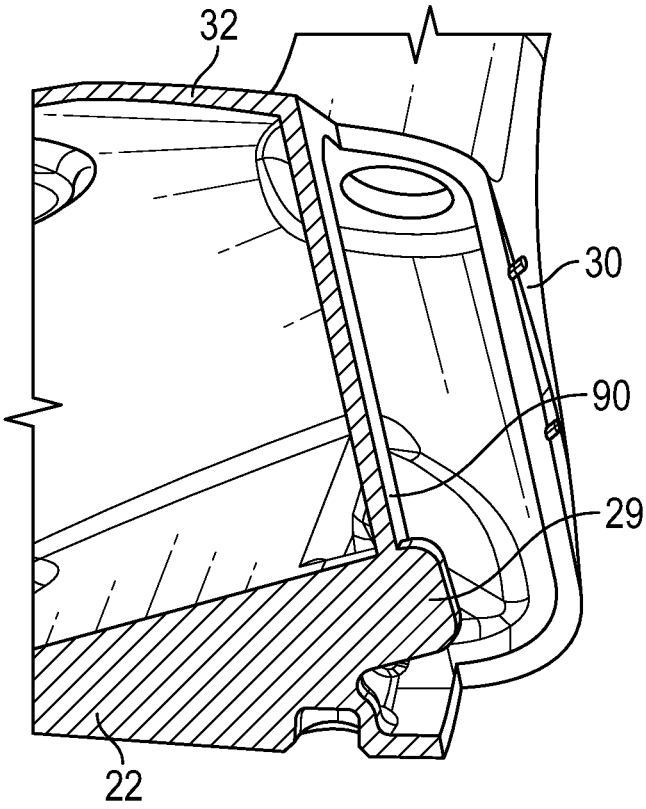
FIG. 27 is a cross-sectional view of the embodiment shown in FIG. 23 taken along lines 27-27.
Figure 28:
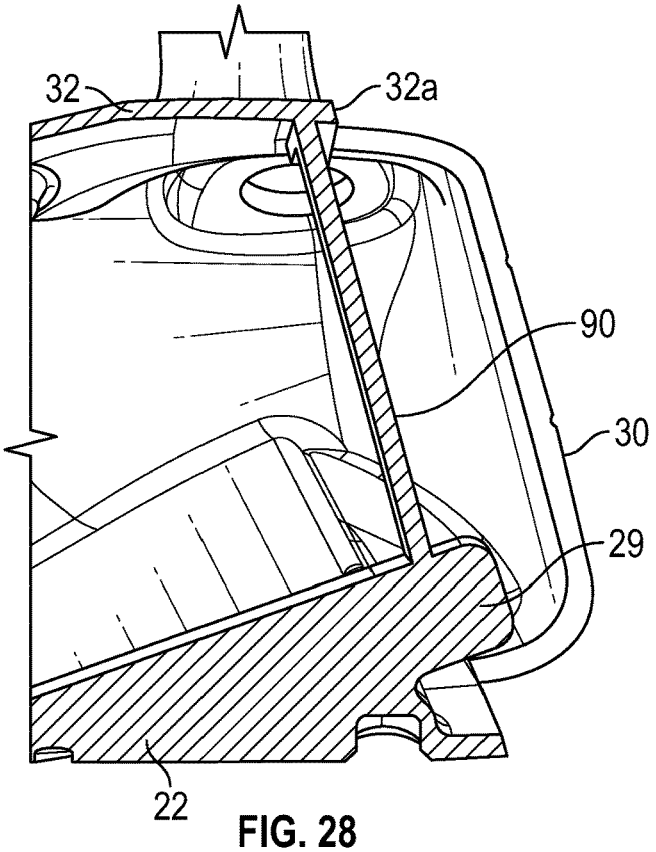
FIG. 28 is a cross-sectional view of an alternative embodiment with a ledge for receiving a face component.
Figure 29:
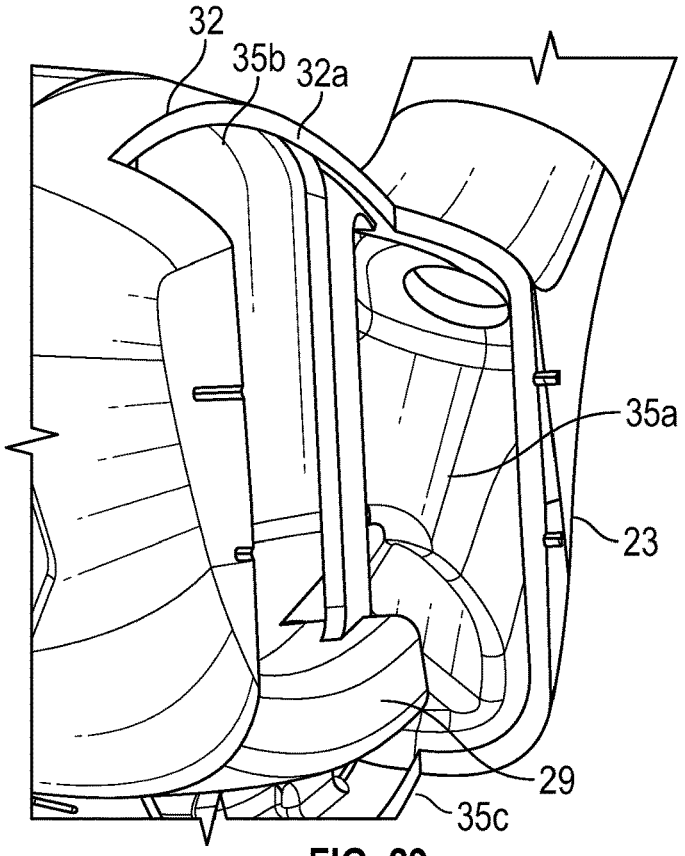
FIG. 29 is a side perspective view of the embodiment shown in FIG. 28.
Figure 30:
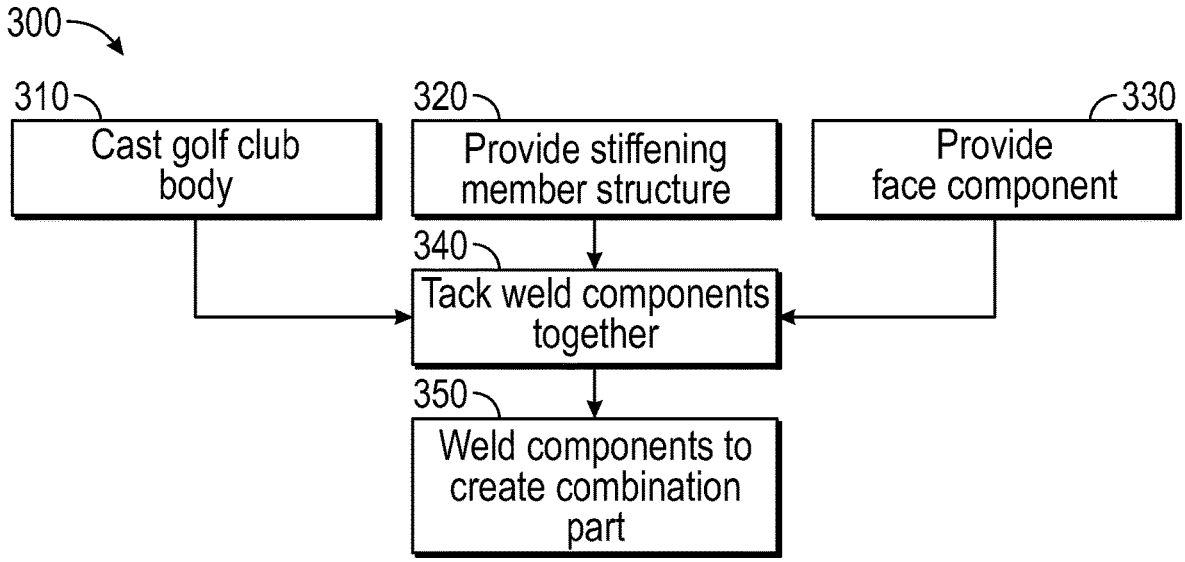
FIG. 30 is flow chart describing another process of creating a golf club head with internal stiffening members.

A preferred method 200 of manufacturing the golf club body 20 with any of the stiffening members 50, 52, 90 shown in the Figures is illustrated and described with reference to FIGS. 20-29. In this method 200, the first step 210 is preparation of a wax mold of the main body 20 that also includes stiffening members 50, 52, 90. In the second step 220, lost-wax casting is employed to cast a first version 21 of the body 20 of the golf club head 10 that includes a preliminary cast 91, including excess material 95, of the stiffening member 90, which in the embodiment shown in FIGS. 21-29 is a plate 90 configuration. The excess material 95 comprises heel and toe side walls 95*a*, 95*b* that connect the stiffening member 90 to the striking face 30 as shown in FIGS. 21 and 22. This single-step casting method 200 eliminates the need for supporting bosses 42, 44 or ribs around the ends of the stiffening member 90, which are intended to assist with casting flow and to reduce porosity in the stiffening member 90, but raise the center of gravity of the golf club head 10 and use up discretionary mass. When creating the plate 90 version shown in these Figures, the cast material can continuously flow from the body 20 to the stiffening member 90. It is particularly helpful for the excess material 95 to follow an s-curve shape to help casting flow.

Figure 31:
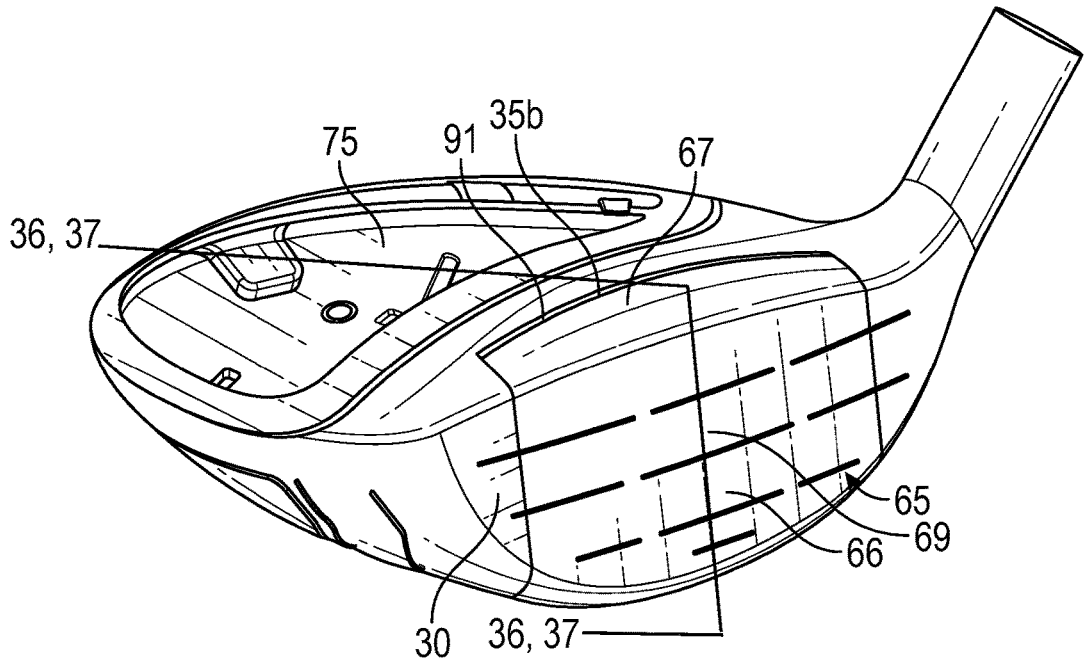
FIG. 31 is a front perspective view of a golf club head created by the method shown in FIG. 30 with a crown insert attached.
Figure 32:
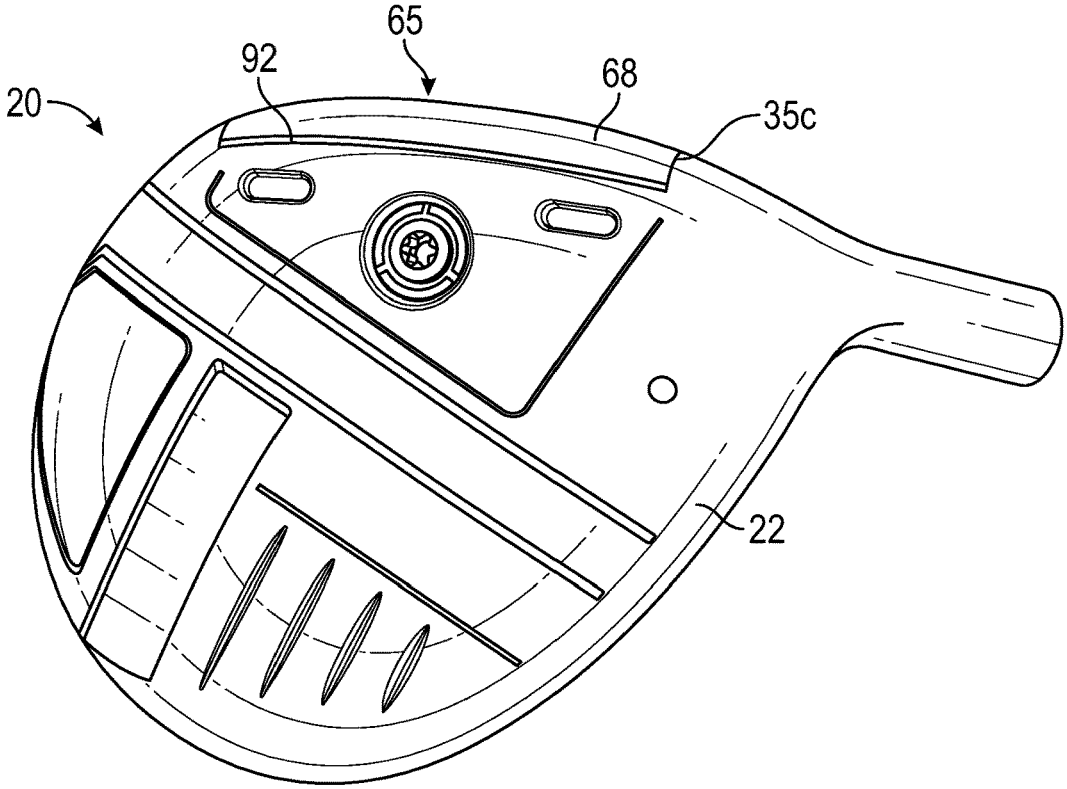
FIG. 32 is a sole perspective view of the embodiment shown in FIG. 31.
Figure 33:
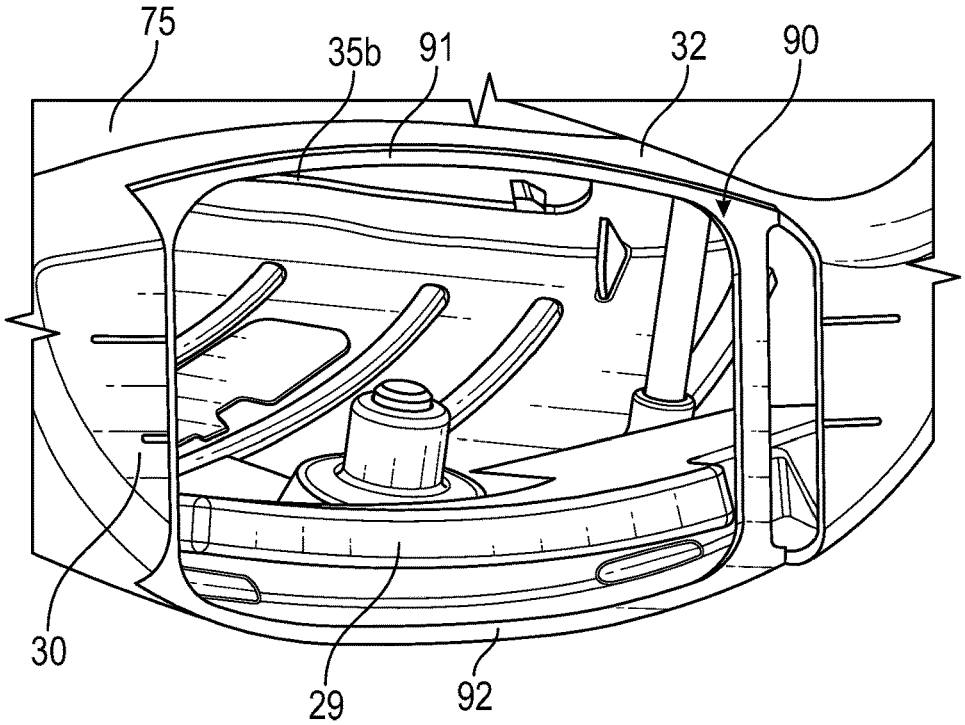
FIG. 33 is a front perspective view of the embodiment shown in FIG. 31 with the face component removed.
Figure 34:
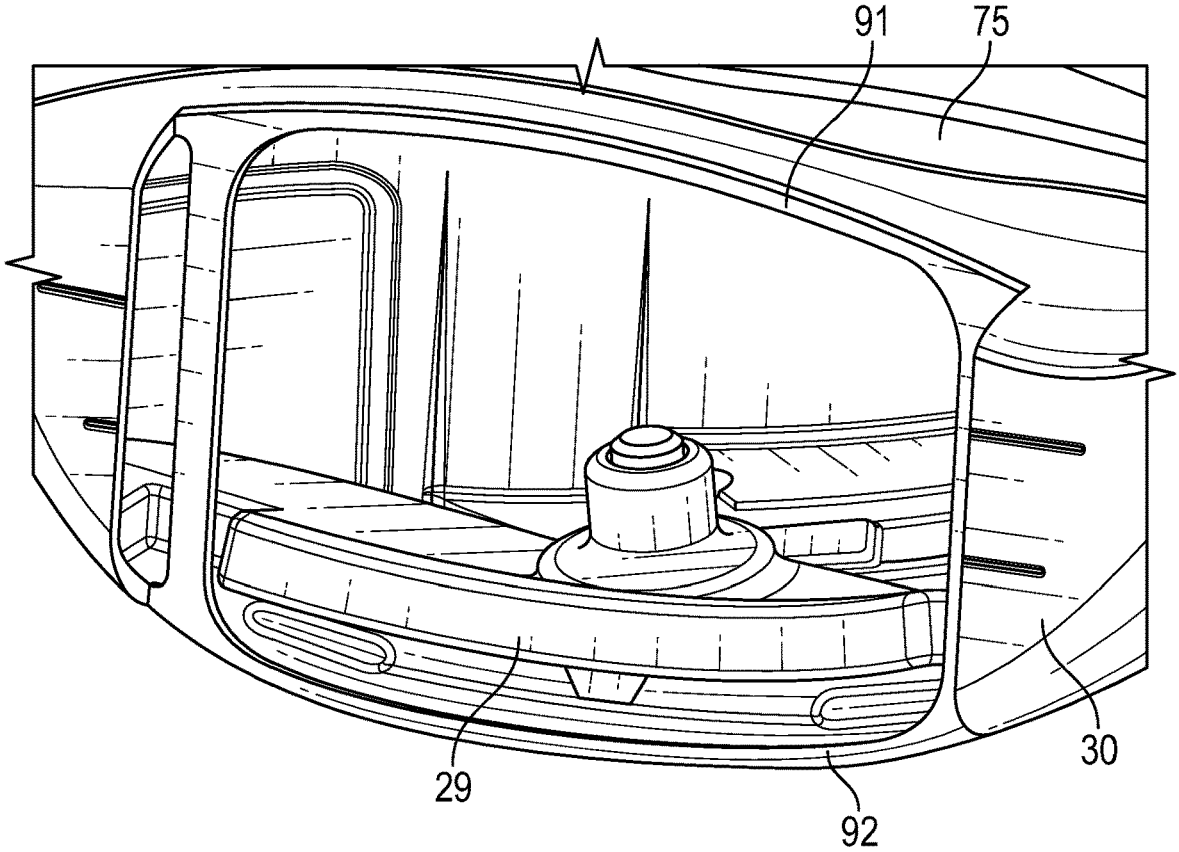
FIG. 34 is another front perspective view of the embodiment shown in FIG. 33.
Figure 35:
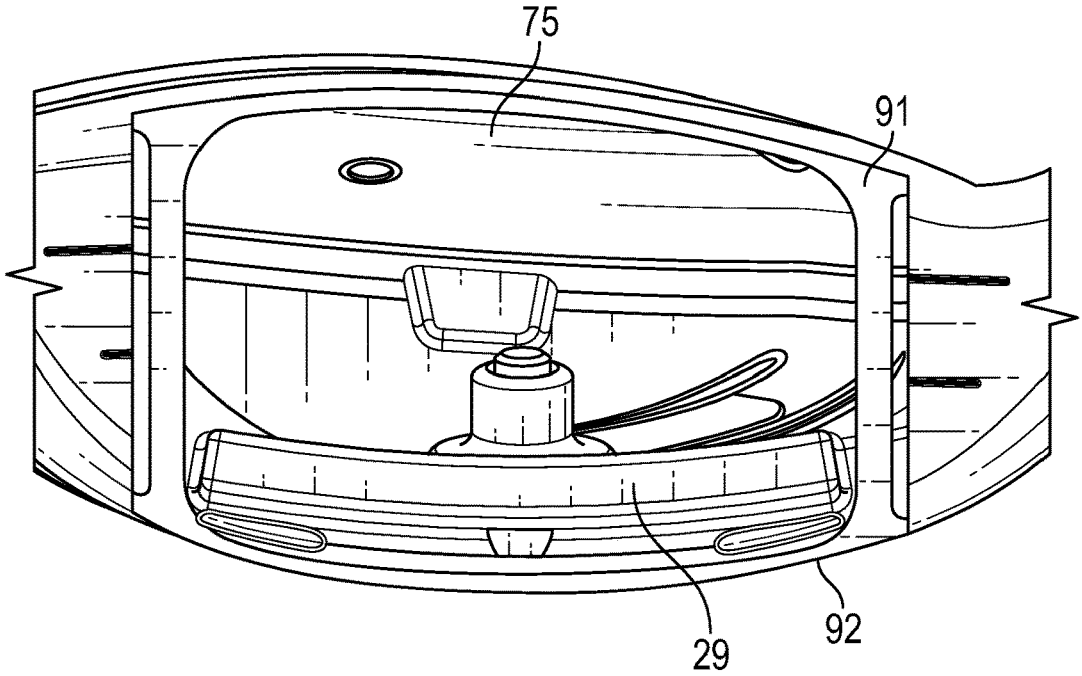
FIG. 35 is a front plan view of the embodiment shown in FIG. 33.

In the third step 230, the excess material 95 is machined away from the preliminary cast 91 to achieve the final shaping and structure of the stiffening member 90 and define spaces 48, 49 between the stiffening member and the heel and toe sides 23, 25 of the body 20. In the embodiment shown in FIGS. 21-29, the stiffening member 90 connects the return section 32 to an interior, "standing wave" weight 29, which stiffens the return section 32 while preserving the flexibility of the sole 22 proximate the face 30. In a further step, a face component, preferably a face cup 65 such as the one shown in FIGS. 31 and 32, can be welded to the body 20 to enclose the interior 27 and the stiffening member 90.

Another method 300 of manufacturing the golf club head with the stiffening members shown in the Figures is illustrated and described with reference to FIGS. 30-37. The first step 310 comprises casting a golf club body 20 with a face opening 35*a*, a return section cutout 35*b*, and a sole section cutout 35*c*. The second step 320 comprises providing, via a manufacturing process such as casting, machining, forging, forming, 3D printing, cutting from a plate of sheet metal, or the like, a plate stiffening member 90, and the third step 330 comprises providing a face component 65, preferably a face cup with a striking plate 66, an upper extension 67, and a lower extension 68, that is sized to fit within and close the face opening 35. The first, second, and third steps 310, 320, 330 may be performed simultaneously or in any sequence.

In the fourth step 340, the upper and lower ends 91, 92 of the stiffening member 90 are tack welded within the return section cutout 35*b* and sole section cutout 35*c*, respectively, of the golf club body 20, preferably so that a cutout 94 in the stiffening member 90 will align with a geometric center 69 of the striking plate 66. The face component 65 is also tack welded to one or more of the edges of the face 30 and the upper and lower ends 91, 92 of the plate 90 to enclose the interior 27, sandwich the upper and lower ends 91, 92 of the stiffening member between the body 20 and the face component 65, and position a majority of the structure of the stiffening member 90 within the interior 27.

Figure 36:
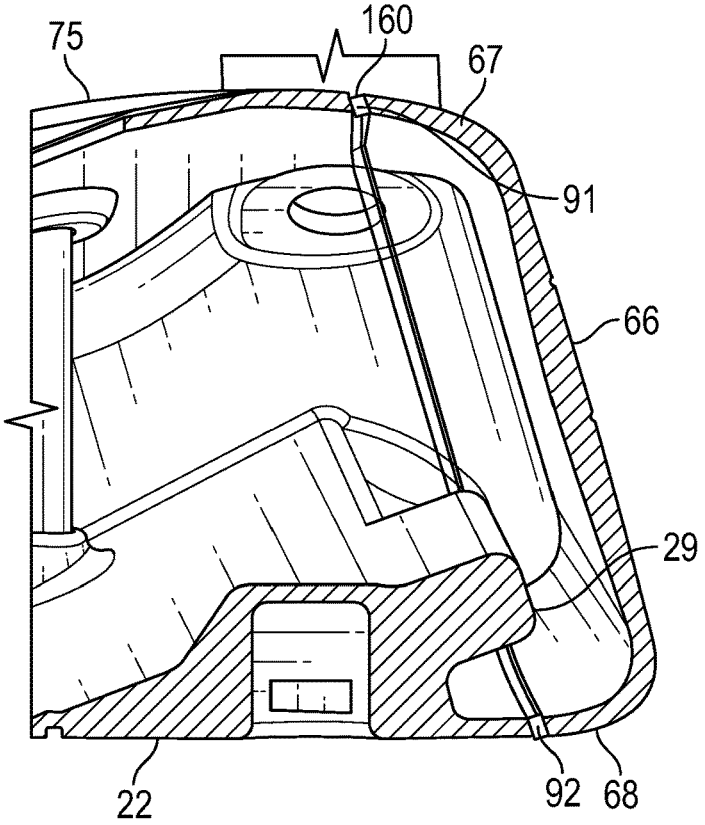
FIG. 36 is a cross-sectional view of the embodiment shown in FIG. 31 taken along lines 36-36 configured for wire feed welding.
Figure 37:
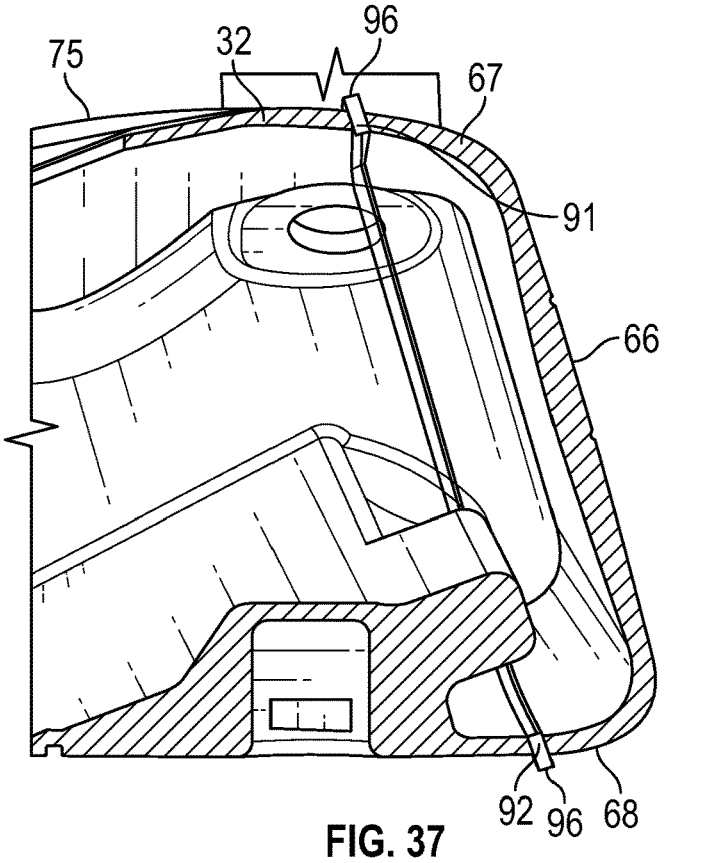
FIG. 37 is a cross-sectional view of the embodiment shown in FIG. 31 taken along lines 37-37 configured for laser welding.

In the fifth step 350, the components are welded together to create a combination part. This welding step 350 may comprise the use of laser or wire-feed welding. If wire feed welding is used, one end 91, 92 of the plate 90 is arranged so that it is flush with the outer mold line of the golf club body 20 on one side, but not the other, as shown in FIG. 36, and the wire fills the resulting gap 160 as the welding occurs. A one-pass wire feed welding method is used with varying weld power to weld across the top and the bottom of the face component 65. If laser welding is used, an additional 0.040 inch of excess length 96 is included in the upper and lower ends 91, 92 of the stiffening member 90 to act as centered weld stock, as shown in FIG. 37. In any embodiments, the stiffening member 90 preferably has a thickness of no less than 0.030 inch and no more than 0.050 inch, and can be cut into any shape from a piece of sheet metal.

As shown in the Figures, any of the embodiments disclosed herein may in include an upper opening 26 that is covered by a crown insert 75 sized to enclose the body 20.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications, combinations, and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A method comprising the steps of:

preparing a wax mold of a golf club head body, the wax mold comprising a striking face section, a front opening, a sole section extending from a lower edge of the striking face section, a return section extending from an upper edge of the striking face section, and a plate stiffening member extending from the return section to the sole section, the striking face section, sole section, and return section defining a hollow body interior;

casting from the wax mold a preliminary golf club head comprising a plate stiffening member with excess material; and machining the excess material away from the plate;

wherein the plate has a thickness ranging from 0.020 inch to 0.160 inch, wherein the plate is located within 1 inch of a rear surface of the striking face section measured along a vertical plane extending through a face center perpendicular to the striking face section, and wherein no portion of the plate makes contact with the striking face section.

2. The method of claim 1, wherein the plate is spaced a distance of no more than 0.210 inch from the rear surface.

3. The method of claim 1, wherein the step of casting a golf club head from the wax mold comprises casting the golf club head from a titanium alloy.

4. The method of claim 1, wherein the plate comprises at least one cutout.

5. The method of claim 4, wherein the at least one cutout aligns with the face center along the vertical plane.

6. The method of claim 1, wherein the plate has a length of 1 inch to 2.5 inches.

7. The method of claim 1, wherein the plate stiffening member extends through the hollow body interior approximately parallel with the rear surface.

8. The method of claim 1, wherein the excess material follows an s-curve shape.

9. The method of claim 1, wherein the sole section comprises an interior weight, and wherein the plate stiffening member extends from the interior weight to the return section.

10. The method of claim 1, wherein the excess material comprises a heel side wall extending in a front-rear direction from a heel-side portion of the striking face section and a toe side wall extending in a front-rear direction from a toe-side portion of the striking face section.

11. The method of claim 1, further comprising the step of affixing a face component to the preliminary golf club head to enclose the hollow body interior.

* * * * *